US011021811B2

(12) United States Patent
Bueno et al.

(10) Patent No.: US 11,021,811 B2
(45) Date of Patent: Jun. 1, 2021

(54) CONTINUOUS METHOD AND SYSTEM FOR THE PRODUCTION OF AT LEAST ONE POLYMERIC YARN AND POLYMERIC YARN

(71) Applicant: Braskem America, Inc., Philadelphia, PA (US)

(72) Inventors: Marcos Roberto Paulino Bueno, Butanta (BR); Alessandro Bernardi, Butanta (BR); Harry Westfahl, Jr., Butanta (BR)

(73) Assignee: Braskem S.A., Camaçari (BR)

( * ) Notice: Subject to any disclaimer, the term of this patent is extended or adjusted under 35 U.S.C. 154(b) by 667 days.

(21) Appl. No.: 15/531,653

(22) PCT Filed: Dec. 2, 2015

(86) PCT No.: PCT/US2015/063383
§ 371 (c)(1),
(2) Date: May 30, 2017

(87) PCT Pub. No.: WO2016/089969
PCT Pub. Date: Jun. 9, 2016

(65) Prior Publication Data

US 2018/0282904 A1 Oct. 4, 2018

Related U.S. Application Data

(60) Provisional application No. 62/086,436, filed on Dec. 2, 2014.

(51) Int. Cl.
*D01F 6/04* (2006.01)
*D01D 1/02* (2006.01)
(Continued)

(52) U.S. Cl.
CPC ..... *D01F 6/04* (2013.01); *D01D 1/02* (2013.01); *D01D 5/06* (2013.01); *D02J 1/228* (2013.01);
(Continued)

(58) Field of Classification Search
CPC . D01D 5/06; Y10T 442/2008; Y10T 428/298; D02G 3/02; D04H 13/00; D01F 6/04; D10B 2321/0211
(Continued)

(56) References Cited

U.S. PATENT DOCUMENTS 4,137,394 A 1/1979 Meihuizen
4,413,110 A 11/1983 Kavesh et al.
(Continued)

FOREIGN PATENT DOCUMENTS

CN 101 798 711 A 8/2010
GB 2042414 A 9/1980
WO 2008/141406 A1 11/2008

OTHER PUBLICATIONS

Substantive Report, Chilean Application No. 1395-2017, dated Dec. 3, 2018.
(Continued)

*Primary Examiner* — Camie S Thompson
(74) *Attorney, Agent, or Firm* — Duane Morris LLP

(57) ABSTRACT

The present invention provides a continuous method for the production of at least one polymeric yarn comprising the steps of: mixing a polymer with a first solvent generating a
(Continued)

mixture; homogenizing the mixture; rendering the mixture inert; dosing the mixture to an extruder; immersing the mixture in a quenching bath (30), wherein an air gap is maintained before the mixture achieves the surface of the liquid of the quenching bath (30) forming at least one polymeric yarn; drawing at least once the at least one polymeric yarn; washing the polymeric yarn with a second solvent that is more volatile than the first solvent; heating the at least one polymeric yarn; drawing at room temperature, at least once, the at least one polymeric yarn; and heat drawing, at least once, the at least one polymeric yarn, wherein the mixture comprises: a polymer comprising ultra-high molecular weight polyethylene, comprising an intrinsic viscosity of from 5 dL/g to 40 dL/g, and a polydispersity index of from 2 to 10; and a first solvent capable of dissolving the polymer under the process conditions, and comprising a dynamic viscosity, measured at a temperature of 37.8° C., according to ASTM D-445, greater than 10 cP. The present invention further provides a continuous system for the production of at least one polymeric yarn, comprising: means for mixing the polymer with a first solvent generating a mixture; means for homogenizing the mixture; means for rendering the mixture inert; means for dosing the mixture to an extruder; means for immersing the mixture in a quenching bath (30), wherein an air gap is maintained before the mixture achieves the surface of the liquid of the quenching bath (30) forming at least one polymeric yarn; means for drawing at least once the at least one polymeric yarn; means for washing for washing the at least one polymeric yarn with a second solvent that is more volatile than the first solvent; means for heating the at least one polymeric yarn; means for drawing at room temperature at least once the at least one polymeric yarn; and means for heat drawing at least once the at least one polymeric yarn, wherein the mixture comprises: a polymer comprising ultra-high molecular weight polyethylene, comprising an intrinsic viscosity of from 5 dL/g to 40 dL/g, and a polydispersity index of from 2 to 10; and a first solvent capable of dissolving the polymer under the process conditions and comprising a dynamic viscosity, as measured at a temperature of 37.8° C. according to the ASTM standard D-445, greater than 10 cP. Further, the present invention provides a polymeric yarn made according to the above stated method.

24 Claims, 7 Drawing Sheets

(51) Int. Cl.
*D01D 5/06* (2006.01)
*D02J 1/22* (2006.01)
*D01D 10/06* (2006.01)

(52) U.S. Cl.
CPC ..... *D01D 10/06* (2013.01); *D10B 2321/021* (2013.01); *D10B 2401/061* (2013.01); *D10B 2401/063* (2013.01)

(58) Field of Classification Search
USPC ..... 264/205, 210.8, 211.14, 210, 211.4; 428/401, 364, 113, 221, 394; 442/60, 442/135; 526/352, 348.1; 89/36.02
See application file for complete search history.

(56) References Cited

U.S. PATENT DOCUMENTS

| | | | | |
|---|---|---|---|---|
| 5,474,722 | A | 12/1995 | Woodhams | |
| 6,218,011 | B1 * | 4/2001 | Raetzsch | D01F 6/06 428/394 |
| 8,003,027 | B2 * | 8/2011 | Da Cunha | D01D 5/06 264/103 |
| 2007/0154707 | A1 * | 7/2007 | Simmelink | D01D 4/02 428/364 |
| 2008/0048355 | A1 | 2/2008 | Tam et al. | |
| 2011/0268967 | A1 | 11/2011 | Tam et al. | |
| 2011/0269359 | A1 | 11/2011 | Tam et al. | |
| 2013/0225022 | A1 | 8/2013 | Tam et al. | |

OTHER PUBLICATIONS

Extended European Search Report, European Application No. 15864618.2, dated Nov. 21, 2018.

* cited by examiner

| | E [GPa] | $E_c$ [GPa] | $AR_c$ | $\delta_c$ [mrad] | $L_c$ | $AR_c$ | $f_c$ |
|---|---|---|---|---|---|---|---|
| Exemplo 1 | 142 | 12 | 300 | 30 | 0.85 | 3 | 0.12 |
| Exemplo 2 | 137 | 11 | 300 | 30 | 0.8 | 3 | 0.13 |
| Exemplo 3 | 168 | 21 | 90 | 30 | 0.8 | 4 | 0.07 |
| Exemplo 4 | 149 | 20 | 63 | 32 | 0.7 | 2 | 0.05 |
| Exemplo 5 | 143 | 18 | 52 | 29 | 0.6 | 2 | 0.02 |
| Dyneema SK75 | | - | 180 | 37 | - | 2.1 | 0.10 |
| Dyneema SK76 | | - | 21 | 75 | - | 1.6 | 0.10 |
| Spectra | | - | 25 | 73 | - | 1.65 | 0.09 |

FIG. 5

CONTINUOUS METHOD AND SYSTEM FOR THE PRODUCTION OF AT LEAST ONE POLYMERIC YARN AND POLYMERIC YARN

TECHNICAL FIELD

The present invention is related to a method and equipment for producing ultra high performance yarns. More specifically, the present invention describes a continuous method for producing polyolefin yarns having ultra high tenacity and modulus according specific manufacture criteria.

DESCRIPTION OF THE STATE OF THE ART

The term high performance yarn (HP-yarn) is used to classify highly oriented polymeric materials in the direction of the fibers and are recognized by their high mechanical strength and high elastic modulus, especially considering their density, as compared to a steel cable, for example, which comprises steel wires of high tensile strength, which is around 2 to 3 GPa and an elastic modulus of about 200 GPa.

In turn, a high performance aramid yarn, for example, from the family of the Kevlar® product (manufactured by DuPont) or Twaron® (manufactured by Teijin), has a tensile strength of between 2.8 and 3.6 GPa and an elastic modulus of between 60 and 70 GPa.

A UHMWPE (ultra high molecular weight polyethylene) high performance yarn manufactured by DSM or Honeywell, for example, has a tensile strength of between 3.0 and 3.6 GPa and an elastic modulus of between 80 and 130 GPa.

However, upon comparing these materials as to their performance in commercial applications, the specific resistance, where density is taken into account, is the more suitable parameter to be considered. When the material is in the form of a yarn, the specific resistance thereof is given by the breaking strength divided by its linear density. In the International System of Units, the linear density of textiles is designated by tex (weight, in grams, of 1,000 m of yarn) and the specific resistance unit—cN/dtex—is one of the most used units, which represents 0.1 GPa/(g/cm3).

Linear densities of the aforementioned materials, steel yarn, aramid yarn and UHMWPE yarn are 7.86 g/cm3, 1.44 g/cm3 and 0.97 g/cm3, respectively. Based on the linear densities, their respective specific resistances can be derived and the following values are obtained: for the steel yarn, between 3 to 4 cN/dtex; for aramid, 19 to 24 cN/dtex; and for the UHMWPE yarn 31 to 37 cN/dtex. Thus, their specific modules are: for the steel yarn of around 250 cN/dtex; for aramid of between 400 and 500 cN/dtex; and for the UHMWPE yarn of from 825 to 1340 cN/dtex.

Therefore, due to its specific strength and modulus, the UHMWPE yarn is deemed to be the yarn having the greater textile performance existing in the market and for that reason, it has been used in noble applications such as ballistic protection and anchorage of Offshore oil and gas platforms.

Even though the use of UHMWPE yarns has grown considerably in the last decades, especially due to the market of ballistic shielding, the use thereof is still restricted to a relatively small number of applications. This is mainly because the cost of manufacturing of these yarns is still very high as compared to commodity yarns such as polyester and polyamide yarns, and their low performance as to certain criteria, such as melting point and flowability.

Due to the chemical nature of these yarns, their low thermal resistance can be considered an intrinsic disadvantage of the material. In spite of the considerably better thermal strength than the conventional polyethylene yarn, mechanical properties of this material are compromised at temperatures of more than 70° C. For example, this has limited its progress in the steel cable market share in many structural applications.

On the other hand, even though it is difficult to increase thermal strength of the UHMWPE yarn, the creep resistance thereof has evolved much during the last years and has been the subject of several patent documents, due to the increasing knowledge gained of the material's microstructure, wherein microstructural parameters associated with constant developments in manufacture processes have shown that the properties of this material can evolve a lot.

The chemical nature of polyethylene, which is characterized by the absence of strong intermolecular interactions is responsible for its intrinsic low thermal resistance. At the same time, such nature allows that drawing of the yarn (during manufacture), under appropriate conditions, increases other important properties, such as the elastic modulus, breaking strength and work to break, resulting in an exceptional ballistic performance.

Also, the high degree of freedom and motility of molecular segments of the polyethylene chain renders the material very susceptible to the processing conditions during manufacture. That is, at the molecular level, the polyethylene polymeric chain is the simplest as compared to other polymers. However, the organization thereof at the microstructural level is quite complex. The understanding of this microstructure associated with its manipulation by changing variables in the process has shown that the material is still in constant development and will still grow in markets where it is not yet used.

The first studies for the development of high performance yarns were made in the 30's. Reports published by Carothers et al. and Mark have shown the high potential of the mechanical properties of polymeric materials if their chains could be oriented in the same direction. The polymeric chains have extremely high theoretical mechanical properties, so if any method of polymeric processing was capable of providing orientation to them, materials of very high mechanical performance could be produced.

However, only in the 70's some processes capable of providing these materials began to emerge. Among these processes, we can mention spinning and solidification of liquid crystals generating the Kevlar®, carbonization of precursor polymeric fibers giving rise to the carbon fiber, superdrawing of yarns and linear polyethylene films and crystallization of flexible molecular chains under high elongational flow, which resulted in a series of materials of high elastic modulus and high mechanical strength.

In this context, in the late 70's, G. C. E. Meihuizen, N. A. J. Pennings and G. A. Zwijnenburg published document U.S. Pat. No. 4,137,394, which describes a process for the production of a UHMWPE yarn based on the molecular orientation of the polymeric chains of UHMWPE in solution under high elongational flow obtained in a machine based on the Couette apparatus. However, such a manufacture process was not commercially viable for the production of the UHMWPE yarn.

The years after the publication of document U.S. Pat. No. 4,137,394 were marked by important publications of other patent documents, wherein a number of researchers worldwide proposed more viable processes for the preparation of said material. Then in the early 80's, there were published patent documents that provided the two main processes for the preparation of the UHMWPE yarn used nowadays. The yarn produced by this process is known by the acronyms HPPE (High Performance Polyethylene yarn) and HMPE (High Modulus Polyethylene Yarn).

The first group, disclosed by document GB 2,042,414A gave rise to what we now know as "volatile solvent based gel spinning process" or "decalin based gel spinning process", hereinafter simply designated as "decalin based process", which has evolved and developed market under the brand name Dyneema®. The second group, disclosed by document U.S. Pat. No. 4,413,110 gave rise to the process known as "non-volatile solvent based gel spinning process" or "mineral oil based gel spinning process", hereinafter simply designated as "mineral oil based process", which has also evolved and developed market under the brand name Spectra®.

Although the commercial products from these processes seem to have achieved a certain level of properties, most likely caused by a relationship between the cost of manufacturing and market price, both are still the object of high investments in research. Based on the products described in a catalog and offered to the market, these yarns can achieve mechanical properties such as tenacity in the range of from 28 to 35 cN/dtex and an elastic modulus in the range of from 80 to 130 GPa.

There is still a third important feature: creep resistance. This property has an essential importance in growing strategic markets, such as cables for offshore platforms. Benchmarking works in addition to data from the literature have shown that yarns produced by DSM Dyneema SK78 have better creep resistance as compared to other producers, wherein the creep rate in region II is in the range of 0.015 to 0.020%/h, as measured at a temperature of 21° C. and a stress of 930 MPa. Furthermore, the creep lifespan of these yarns, is greater than 10 h, as measured at a temperature of 70° C. and stress of 600 MPa. Although DSM has recently launched a product with high creep resistance designated as Dyneema DM20, with better creep resistance than SK78, this product has lower tenacity and elastic modulus and is specifically directed to the market of permanent Offshore anchorage.

Intensive work for the development of processes and products started after the first publications in the early 80's, resulted in a number of patent documents, showing the large development on the knowledge of manufacturing process and properties of these materials. Many are the claimed processes and features, which resulted in a remarkable improvement in the mechanical properties that go beyond the level of mechanical properties of the aforementioned commercial yarns. A limit between the two classes should be defined, namely: high performance UHMWPE yarn, or commercial UHMWPE yarns, characterized by the aforementioned mechanical properties and ultra high performance UHMWPE yarns.

Also, there should be defined a performance criteria describing the ultra high performance UHMWPE yarn designated herein as comprising a tenacity greater than 33 cN/dtex, an elastic modulus greater than 120 GPa, a creep rate in region II of less than 0.02%/h, as measured at a temperature of 21° C. and a stress of 930 Mpa, and lifespan greater than 10 h, as measured at a temperature of 70° C. and stress of 600 MPa. This class is distinct from that designated herein as "commercial class", as defined above, in that it has an optimal balance of properties.

However, viability of producing ultra high performance UHMWPE yarns is still a challenge to be overcome by the technologies known in the state of the art. Issues related to the degree of industrial viability must be taken into account when a new process is developed. A large number of patent documents filed over the last ten years are directed to processes capable of producing ultra high performance yarns. However, a careful and critic evaluation of the formulations used in the examples shows that polymers having relatively high molecular weight are used to produce these yarns.

A person skilled in the science of polymers broadly knows that generally the mechanical properties evolve with the molecular weight. Specifically in the case of the UHMWPE yarn, mechanical strength of the yarn is known to increase with the molecular weight due to microstructural parameters.

HMPE yarns have, at the microstructural level, basically three phases having a structural role. Two phases comprise crystalline regions (having an order in the three dimensions) bonded to each other by "amorphous" phases or restricted phases. There is a third phase formed by a network of extended, very long polyethylene chains capable of traversing a number of crystallites, also known as tie molecules. As the molecular weight increases, the population of these tie molecules is also increased, which improves the mechanical properties.

However, an increase in the size of the polymeric chain renders the manufacturing process of these yarns very difficult. An excessive increase of the molecular weight suddenly increases both the difficulty in dissolving the polymer in the first solvent and the elongational viscosity of the yarn being drawn. Since the length of the draw lines is usually constant, it represents a reduction in the velocities applied to the same, which causes a proportional increase in the cost of manufacturing.

However, when a gel spinning process is used, there is a way of minimizing the above stated effect, since this process allows for the degree of molecular entanglement to be manipulated by diluting the polymer in the starting recipe. In other words, dilution enables that part of the increase in the elongational viscosity caused by using a greater molecular weight is compensated by the greater molecular motility given by the reduction in the molecular entanglement, thereby reducing stress on the yarn being drawn. It enables processing of the yarn under industrially viable speeds.

The gel spinning process uses a large amount of solvents to dissolve the ultra-high molecular weight polyethylene (UHMWPE). Dissolution is usually made in an extruder, where a suspension containing a typical concentration range of from 5 to 12% is fed. Molecular entanglement of UHMWPE is reduced in the dissolution process, which prevents it from being processed in usual machines used in polymer processing. It is known that the greater the polymer concentration in the system feed, the better will be drawability of the yarn and, accordingly, the better will be the mechanical properties achieved.

On the other hand, the combined action of the increase in the molecular weight using dilution allows for yarns having exceptional mechanical properties be obtained. However, there is a viability limit for this relationship due to the obvious reduction in throughput caused by dilution. Thus, as the molecular weight of the polymer used increases, a higher amount of solvent is required (so as to increase dilution of the polymer). However, it causes the cost of manufacturing of these yarns to be very high.

As far as the combined action of the increase in the molecular weight using dilution allows for yarns having exceptional mechanical properties to be obtained, there is also a limit of viability for this relationship. This is due to the obvious reduction in throughput given by this dilution. In context of the present invention, it is important to define a limit of industrial viability, where outside this limit the process has elevated cost. To that end, the inventors consider an industrial viability criteria defined by the use of the molecular weight of the UHMWPE polymer, characterized by an intrinsic viscosity (IV) of less than 20 dL/g and a concentration of this polymer in the feed suspension of greater than 8%.

Therefore, the state of the art fails in providing a method of producing HMPE yarns using a polymer of high molecular weight, but having a low dilution rate, resulting in a low cost of manufacturing.

With regard to the inner structure of the HMPE fibers, each fiber consists of a set of filaments formed in capillaries of the spinneret. Each filament has a diameter of the order of 10 μm and comprises about 100 macrofibrils having diameters of the order of 1 μm. Each macrofibril is in turn formed by microfibrils having diameters of the order of 10 nm. These microfibrils are alternated arrangements of nanocrystals having a length of the order of tens of nanometers and not crystalline regions having lengths of the order of 25% to 35% the length of nanocrystals. Laterally between the crystallites there may be void regions (extended nanopores) of hundreds of nanometers.

From the structural point of view, the longer the nanopores, the greater the persistence length of the microfibrils; and the narrower and more oriented the microfibrils, the more homogeneous and better oriented they will be. These nanopores are, nonetheless, very diluted within the macrofibrils, not having any type of spatial correlation of short or long distance between each other.

From the micromechanics point of view, almost perfect PE crystals have an elastic modulus of the order of 200 to 300 GPa, while amorphous regions are formed by well oriented, while non-crystalline, chains having a modulus of the order of from 1 to 2 GPa. Also according to this model, the fraction of chains participating in the crystallites increases with the increase in the draw ratio of the fiber.

Therefore, since the mechanical properties of these crystalline, amorphous and void regions are very different, the sizes and the shapes with which these spaces are spatially organized determine the final mechanical properties of the fibers.

This set of parameters describes what we designate as microstructure of the fiber. Thus, the best way to improve the mechanical properties of a HMPE yarn is by improving the microstructure thereof.

Document US2011/0269359A1 discloses a yarn having a tenacity greater than 45 g/denier (40 cN/dtex) and an elastic modulus greater than 1400 g/denier (1236 cN/dtex or 120 GPa). However, the method of manufacturing this yarn is based on start polymers having molecular weights of greater than 30 dL/g. The examples of polymers mentioned in document US2011/0269359A1 comprise very high IV values and high dilution rates.

Document US2011/0268967A1 in turn describes a production process where a mineral oil base technology is used. In the examples of said document, UHMWPE yarns are obtained using start polymers of high molecular weight and relatively low dilution levels. However, the performance levels achieved in such a process are clearly insufficient, wherein, for example, a maximum elastic modulus of 1386 g/denier (119 GPa) is achieved in the disclosure of Example 2 herein.

Patent document US2013/0225022A1 seeks protection to a ultra high performance yarn, with tenacity of greater than 45 g/denier (40 cN/dtex). In the examples, a dilution level of 8% is used. Nevertheless, the document seeks protection to a yarn obtained using high molecular weight, characterized by IV of more than 21 dL/g.

OBJECTS OF THE INVENTION

The object of the present invention is to provide a mineral oil based continuous method for the manufacture of a polyolefin UHMWPE yarn, which uses production criteria that enable one to optimize the mechanical properties of the produced yarn.

BRIEF DESCRIPTION OF THE INVENTION

In order to achieve the above objects, the present invention provides a continuous method for the production of at least one polymeric yarn comprising the steps of: mixing a polymer with a first solvent to provide a mixture; homogenizing the mixture; rendering the mixture inert; dosing the mixture to an extruder; forming a homogeneous solution; dosing the solution in an orifice die, providing the solution with the shape of filament yarn; immersing the mixture in a quenching bath (30), wherein an air gap is maintained before the mixture achieves the surface of the liquid of the quenching bath (30) forming at least one polymeric yarn; drawing at least once the at least one polymeric yarn; washing the polymeric yarn with a second solvent that is more volatile than the first solvent; heating the at least one polymeric yarn; drawing at room temperature, at least once, the at least one polymeric yarn; and heat drawing, at least once, the at least one polymeric yarn, wherein the mixture comprises: a polymer comprising ultra-high molecular weight polyethylene, comprising an intrinsic viscosity of from 5 dL/g to 40 dL/g, and a polydispersity index of from 2 to 10; and a first solvent capable of dissolving the polymer under the process conditions, and comprising a dynamic viscosity, as measured at a temperature of 37.8° C., according to ASTM D-445, greater than 10 cP.

The present invention further provides a continuous system for the production of at least one polymeric yarn, comprising: means for mixing the polymer with a first solvent generating a mixture; means for homogenizing the mixture; means for rendering the mixture inert; means for dosing the mixture to an extruder; means for forming a homogeneous solution; means for dosing the solution in an orifice die, providing the solution with the shape of filament yarn; means for immersing the mixture in a quenching bath (30), wherein an air gap is maintained before the mixture achieves the surface of the liquid of the quenching bath (30) forming at least one polymeric yarn; means for drawing at least once the at least one polymeric yarn; means for washing the at least one polymeric yarn with a second solvent that is more volatile than the first solvent; means for heating the at least one polymeric yarn; means for drawing at room temperature at least once the at least one polymeric yarn; and means for heat drawing at least once the at least one polymeric yarn, wherein the mixture comprises: a polymer comprising ultra-high molecular weight polyethylene, comprising an intrinsic viscosity of from 5 dL/g to 40 dL/g, and a polydispersity index of from 2 to 10; and a first solvent capable of dissolving the polymer under the process conditions and comprising a dynamic viscosity, as measured at a temperature of 37.8° C. according to the ASTM standard D-445, greater than 10 cP.

Further, the present invention provides a polymeric yarn made according to the above stated method.

DESCRIPTION OF THE FIGURES

The following detailed description makes reference to the accompanying drawings, in which:

FIG. 5 illustrates a comparative table of the examples of yarns produced in accordance with the present invention and the yarns produced in accordance with the state of the art.

DETAILED DESCRIPTION OF THE INVENTION

The following description will be based on a preferred embodiment of the invention. As will be evident to the skilled person, however, the invention is not restricted to this particular embodiment.

According to a preferred embodiment that will be described herein, the present invention provides a method for the production of a ultra high performance yarn, preferably, a yarn comprising ultra high molecular weight polyolefin, wherein such yarn is produced with known technology as a mineral oil base.

Figure 1:
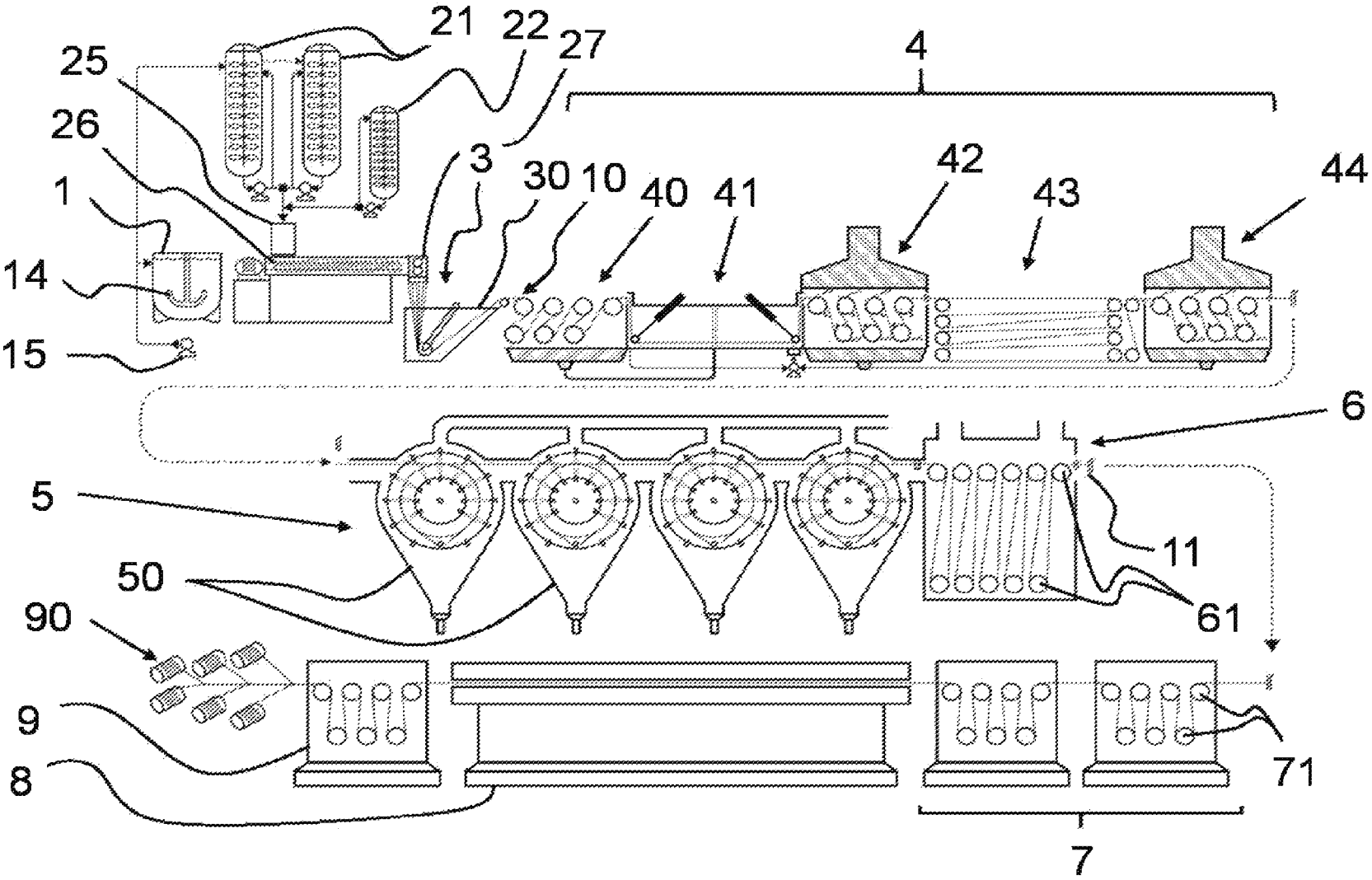
FIG. 1 illustrates a schematic view of a system for the production of polymeric yarns, according to an optional configuration of the present invention.

FIG. 1 illustrates a system for the production of a polyolefin yarn comprising all the units required for the development of the steps of the optional configuration presented by the present invention, namely:

(a) mixing, with the aid of the premix vessel 1, the ultra high molecular weight polyolefin polymer with the first solvent and additives;

(b) transferring the mixture to a homogenization and inertization device, optionally a homogenization/inertization tank 21,22, where the mixture will remain for a time sufficient to become homogeneous and virtually free of oxygen;

(c) dosing the mixture, steadily and intermittently, with the aid of a dosing device 25 in an extruder 26;

(d) dissolving the polymer in the first solvent under an intensive condition, within the extruder 26, so as to form a homogeneous solution;

(e) dosing the solution in a volumetric and precise manner through an orifice die 27, providing the solution with the shape of a yarn;

(f) dipping the solution, in the form of a yarn, in a water bath, known as a quenching bath 30, such that the yarn, before achieving the water surface, passes through an air gap for the solution to coagulate thereby forming the polymeric yarn 10 (gel yarn), wherein, optionally, the polymeric yarn is stretched in the air gap;

(g) passing said gel yarn through a tower of feeding rolls 40, such that part of the water dragged by the yarn from the quenching bath 30 and a fraction of the first solvent, exudated from the yarn in the coagulation, are drained by the action of gravity;

(h) drawing 41 the gel yarn 10 in a tank containing a liquid medium;

(i) passing the drawn gel yarn through a first pre-recovery enclosure 42, wherein the first exudated solvent and liquids dragged from the drawing tank are mechanically retained;

(j) passing the yarn through an accumulator 43 such that the residence time is sufficient for the exudation method to complete, exposing a greater volume of a first solvent on the surface of the yarn;

(l) passing the gel yarn through a second pre-recovery enclosure 44, wherein the residual solvent fraction exudated by the yarn in the accumulator 43 can be mechanically retained;

(m) feeding the gel yarn containing a reduced fraction of the first solvent with a second solvent in an extraction unit 5;

(n) passing the gel yarn, containing the second solvent, through a dryer 6, wherein the second solvent is substituted with a heated gas, yielding the xerogel yarn 11;

(o) drawing the xerogel yarn, preferably in a continuous manner, in at least one heat draw step, preferably, drawing the precursor yarn in a minimal of two steps of heat drawing and, more preferably, applying a stress relaxation step without shortening, between the heat draw steps, yielding the POY yarn (Pre Oriented Yarn);

(p) heat drawing the yarn (POY) in a draw oven; and (q) storing the yarn in bobbins in the winding unit 90.

Optionally, a high or ultra high molecular weight polyolefin is used in the method for the production of a ultra high performance yarn of the present invention. Polyolefins such as high molecular weight polyethylene or ultra-high molecular weight polyethylene (UHMWPE), such as high and ultra high molecular weight polypropylene and an ethene-propene copolymer can be used. However, other polymers can be used, such as polyvinyl alcohol, polyesters, polyoxide ethylene. More preferably, ultra-high molecular weight polyethylene (UHMWPE) is used.

For use as a first solvent, any solvent that dissolves the above polymers under the method conditions described herein can be used. More specifically, any solvent with a solubility parameter consistent with the used polyolefin and which supports the operating temperature of the method can be used. Preferably, any solvent with a solubility parameter consistent with the used polyolefin and which is not considerably volatile at the dissolution temperature can be used. Preferably, mineral oil is used when the polyolefin is ultra-high molecular weight polyethylene. More preferably, the solvent is preferably chosen from classes such as aliphatic hydrocarbons, cyclo-aliphatic hydrocarbons, aromatic hydrocarbons, halogenated hydrocarbons, and mixtures thereof. In another context, the first solvent should have a vapor pressure greater than 20 kPa or a boiling point greater than 180° C. and that dissolves the polymer under the process conditions described in the invention.

The polymer concentration is recognized as one of the main method variables in the technology related to the context of the present invention. Such polymer concentration in the first solvent is linked to technical and economic aspects of the method. In context of the present invention, the concentration choice will be, therefore, a result of the balance between the intended better mechanical property and the method cost. In this regard, the mass concentration range of the polymer in the first solvent is from 3 to 30%, preferably, from 5 to 20% and, even more preferably, of from 8 to 15%.

As is known, the combined action of the increase in the molecular weight using dilution allows for yarns having exceptional mechanical properties be obtained. However, there is a viability limit for this relationship. This is due to the obvious reduction in yield given by this dilution. Therefore, in accordance with the present invention an industrial viability criteria defined by the use of the molecular weight of the UHMWPE polymer, characterized by an intrinsic viscosity (IV) of less than 20 dL/g and a concentration of this polymer in the feed suspension greater than 8% are preferably adopted.

Surprisingly, process studies have shown that the limit of this relationship can be altered by the combined action of molecular parameters associated with certain restricted conditions of a process. The present invention discloses a novel process capable of producing yarns that meet the aforementioned performance requirements, and which classify the yarn as being of ultra high mechanical performance, where the recipe used takes into account the industrial viability criteria, as also described above.

Also surprisingly, the yarn obtained in such a process exhibited a microstructure that is not present in the state of the art, where instead of a large short period lamellar fraction, it exhibited a new fibrillar architecture formed by a more elongated, paracrystalline fraction of high order associated with a more restricted amorphous phase capable of effectively supporting and transferring stress between the crystallites. Such amorphous phase of high modulus is the direct result of a more coherent microstructure, which is in turn a consequence of a reduced population of low molecular weight chains during the spinning process. Factors that interconnect with each other, i.e., polymer molecular weight distribution, processing condition and innovative microstructure, result in the new material described in the present invention.

Thus, in accordance with the present invention, the starting formulation that will be added to the premix vessel should comprise:

- a polymer comprising ultra-high molecular weight polyethylene (UHMWPE), characterized by having an intrinsic viscosity (IV) of between 5 and 40 dL/g, preferably between 10 and 20 dL/g;
- a polymer comprising ultra-high molecular weight polyethylene (UHMWPE), characterized by having a polydispersity index (PDI) of between 2 and 10, preferably between 3 and 6); and
- a first solvent capable of dissolving the aforementioned polymer under the process conditions and also by having a dynamic viscosity ($\eta_s$), according to ASTM D-445 (as measured at a temperature of 37.8° C.), greater than 10 cP, preferably greater than 30 cP.

Referring again to FIG. 1, a schematic representation of the optional configuration of the method of the present invention is shown, where a number of mixing and dosing equipments are placed such that the polymer mixture, first solvent and additives can be appropriately added to an extruder 26. For ease of nomenclature, the set formed by all the equipments involved in the function of providing a homogeneous mixture in the extruder 26 will be hereinafter designated as dosing device 25.

Furthermore, the system of the present invention comprises a premix vessel 1 where suitable amounts of the components are added such that a homogeneous mixture is obtained. The premix vessel 1 optionally comprises a mixing impeller 14, a pumping device 15, preferably of the jet mixing type, to cause the mixture to be constantly stirred from the bottom of the premix vessel to the top thereof. Therefore, the mixture is homogenized during the required time before being pumped to at least one inertization device 21,22. For ease of nomenclature, the inertization device will also be designated as inertization vessel herein.

Optionally, the at least one inertization vessel 21,22 still provides homogenization of the mixture in a similar fashion as the premix vessel. However, the inertization vessel 21,22 further comprises an inertization gas flow used to extract oxygen from the mixture, thereby causing it to be inert. The oxygen content in the mixture is optionally monitored by suitable sensors until acceptable levels are achieved.

Optionally, the system of the present invention comprises two inertization vessels, as illustrated in FIG. 1.

Dosing of the mixture in the extruder can be made by any dosing device known in the state of the art, provided that it can maintain a homogeneous solids concentration. The dosing device 25 is intended to continually feed the extruder 26 with the homogeneous and inertized mixture provided by the inertization vessel 21,22.

Optionally, dosing is made such that a small amount of the mixture is always above the extruder screw. To that end, the level is adjusted so as to be between an upper limit (above which a column of liquid with no agitation forms a gradient of solid settling) and a lower level that prevents the gas from entering the extruder. Thus, agitation caused by rotation of the extruder screw will ensure homogeneity of the column of mixture. For these settings to be implemented, the dosing device may comprise a level sensor. Thus, where the level of the mixture inside the dosing device 25 is below a predetermined value, an electrical input deviates a valve to the tube, feeding the dosing vessel 25 until an upper level signal reverses the valve back to its original position. In order to prevent contamination by oxygen from air, a flow of inert gas is optionally maintained within the vessel 25. To that end, the dosing vessel 25 optionally comprises a gas inlet tube and a gas outlet tube. It should be emphasized that, as noted, any level control device known from the state of the art can be used as the dosage form. However, the above device is preferably used.

Further, the present invention provides the optional use of a start and stop vessel 23 when the described system of preparation, homogenization, inertization and dosing of the mixture is used. Such start and stop vessel 23 is only intended to be used in the beginning and in the end of the described method, since it is intended to provide a more diluted mixture of polymers in the start and final steps of the extruder. This allows for the extruder to be started at the normal rotation of the method, without any damages to the equipment being caused by pressure peaks, which can occur in a start at high rotation. This procedure thus avoids unbalancing of the method caused by a poor dissolution of the mixture present in the inertization vessel. High and ultra high molecular weight polymers are hard to dissolve and the unbalance of the method, which occurs mainly while starting and stopping the extruder, results in clumps or poorly dissolved particles which act as a defect to the formed yarn, thereby reducing its local drawability. The extruder being started under optimal conditions, in addition to preventing this kind of problem, will lead to rapid stabilization conditions, minimizing the residue volume at the start.

Optionally, the present invention makes use of only two inertization devices 21,22, wherein one of the inertization devices, in the steps of start and end of the extruder 25, feeds the extruder 26 with a more diluted polymer mixture, such that, this device is thereafter used with the mixture with standard dilution.

Optionally, the dosing device is a container, or an tube, which simply drives the mixture from the inertization device to the extruder. Also, in another optional embodiment, the dosing device is integrated to the extruder, or is part of the extruder.

Therefore, in context of the present invention, the suspension dosage system in the extruder, comprises:

a) a premix vessel 1, where all the components of the suspension are added, comprising a mechanical stirrer and a pumping circuitry, thus ensuring a better homogenization of the mixture;

b) at least one inertization vessel (optionally two vessels) 21,22, comprising a mechanical stirrer, a pumping device 201 (optionally of the jet mixing type) constantly circulating the bottom mixture to the top of the vessel 21,22, am inert gas feeding device and a device for measuring the oxygen content, such that inertization is ensured;

c) a dosing device 25 comprising a level control device, such that the level of the mixture, as defined by the column of suspension liquid above the level of the extruder screw, can be controlled, wherein the dosing device is fed by at least one inertization vessel, such that a valve installed on the bottom of the inertization vessel controls said feeding and releases a certain volume of suspension when a signal of low level in the dosing vessel is received, optionally, the dosing vessel is fed with a constant flow of inert gas which is maintained throughout the production;

d) a start and stop vessel 23 used in start and stop operations of the production line, comprising a mechanical stirrer, a pumping device (optionally of the jet mixing type), an inert gas feeding device and an instrument for measuring the oxygen content, optionally the start and stop vessel 23 comprises a reduced volume as compared with the inertization vessel 21,22, wherein the start and stop vessel 23 is fed with a suspension having low polymer concentration, which yields a solution of lower viscosity and for that reason reduces the start pressures of the extruder, allowing it to be turned on at high rotation speeds.

The mixture or suspension homogenized and inertized by the above mentioned system then feeds an extruder 26. In context of the present invention, any type of extruder known in the state of the art can be used, including, but not limited to single-screw, twin-screw and planetary extruders. Combinations of one or more extruders may be used as well, whenever an improvement in the cost effectiveness of the method is desired. However, in the preferred embodiment now described, twin-screw extruders are preferable.

In the extruder 23 the mixture or suspension is transformed into a solution. Dissolution is a difficult process, where process parameters should be defined for each case and each setting of the extruder used. In a particular configuration, when ultra-high molecular weight polyethylene is dissolved in mineral oil, the temperature must be between 150° C. and 310° C., more preferably, between 180 and 240° C.

The polymer solution in the first solvent, produced by the extruder, is then fed to a spinning head 27, which comprises a spinning pump and a spinning die. The spinning pump serves to dose the solution to the spinning die in a precise manner, which in turn serves to impart the shape of a yarn to the fluid. The spinning die or spinneret has a defined number of capillaries. In context of the present invention, the number of capillaries is not a critical parameter and depends on factors such as the production capacity of the extruder, the spinning technology used, the intended final titer of the yarn, etc. In the capillary of the spinning die, the bulk of polymer will be subjected to a first molecular orientation, which takes place under shear and elongational flow along the capillary.

During dosing of the solution, the present invention expects the solution to be subjected to a deformation with initial draw ratio $$\lambda_0 = \left(\frac{D_e}{D_f}\right)^2,$$

wherein De is the inlet diameter of the melt in the spinning die and Df is the outlet diameter. Additionally, the mean angle (a) chosen between the inlet and the outlet should be less than 40 degrees and ideally in accordance with the inequality:

$$\alpha = \frac{180°}{\sqrt{\lambda_0 - 1}}.$$

Thus, for a certain mixture at a temperature T, formed by a starting polymer comprising a certain polydispersity index (PDI) and molecular weight $M_w$ (in g/mol), diluted at a concentration $\phi$ (wt %) in a first solvent of dynamic viscosity $\eta_s(T)$ given in cP, the melt speed at the inlet of the deformation region $V_e$, measured in mm/s, must be have an upper limit given by the inequality:

$$V_e < D_e \frac{T}{\eta_s(T)} \left(\frac{26000}{M_w}\right)^2 \phi^{-7/3} \sqrt{\frac{\log \lambda_0}{\lambda_0 - 1}}$$

On the other hand, the entry speed of the solution must have a lower limit given by inequality:

$$V_e > L \frac{T}{\eta_s(T)} \left(\frac{26000}{M_n}\right)^2 \phi^{7/3} PDI^{2/2} e^{\sqrt{\log PDI}} \frac{1}{(\lambda_0 - 1)},$$

wherein L is the distance (in mm) between the inlet and the outlet of the deformation region.

The yarn of the polymer solution dissolved in the first solvent then passes through the air gap and immerses into the quenching bath 30, where the solution coagulates, yielding the so-called gel yarn 10. In the scope of the present invention, the term air gap is used to define the space traversed by the yarn of the solution, from the outer surface of the spinning die 27 to the liquid surface of the quenching bath 30. The length of the air gap is another variable of critical importance in the method of the present invention. However, it will depend on the spinning condition used. The spinning condition is determined by four variables, basically, the geometry of the capillary, the temperature, flow rate and the use or not of a drawing step after the quenching bath 30. Such drawing will be hereinafter designated as draw down.

When little or no draw down is adopted, the length of the air gap is preferably of less than 15 mm, more preferably of less than 10 mm, on the other hand, the minimal length of the adopted air gap is 2 mm, preferably greater than 4 mm.

However, when draw down stretches are applied to the yarn, the adopted air gap length is greater than 5 mm, preferably greater than 15 mm.

In turn, as already explained, the quenching bath 30 serves to transform the solution into a gel yarn. The gel yarn is a structure composed of a pre-oriented, polymer-containing porous phase that comprises almost the entire volume of liquid comprising the first solvent. Any liquid, in principle, can be used as a quenching liquid, provided that it does not affect the properties of the yarn. When the polymer used us ultra-high molecular weight polyethylene, water is the preferred solvent. The temperature of the quenching bath must be of less than 60° C., preferably of less than 30° C., more preferably of less than 20° C.

Then, the gel yarn 10 formed in the quenching bath and containing a large portion of the volume of the first solvent and water dragged from the quenching bath is fed to a pre-recovery and draw unit in a liquid medium. For ease of nomenclature, the pre-recovery and draw unit in liquid medium will be hereinafter simply designated as pre-recuperator.

The pre-recuperator has a first function of mechanically retaining the largest volume as possible of the first solvent, such that the extractors are not overloaded, which would increase the operational cost of the method. Optionally, the pre-recuperator may perform an intermediate draw on the yarn, which can reduce the draw load that will occur in subsequent steps. The draw limit in this step is determined by the beginning of damage to the polymeric structure and is determined by the final mechanical properties. In the scope of the present invention, the relative amount of the first solvent retained by the pre-recuperator prior to the extraction step is designated pre-recovered amount of solvent and is represented by a pre-recovery index. The pre-recovery index is described by the percent ratio of the mass or volume of solvent transported by a certain length of the yarn that exits the pre-recuperator and the yarn entering the pre-recuperator.

As already discussed, one disadvantage, if not the greatest, of the mineral oil base technology is the need for recovering a large volume of the first solvent using a second, more volatile solvent. When, for example, the first solvent is mineral oil and the second solvent is of the n-hexane type, the separation thereof in a distillation column is relatively easy due to the large difference in the boiling points of the mixture components. However, even if the distillation column is very efficient, the n-hexane content present in the oil of the bottom of the column remains elevated.

A small n-hexane concentration in the mineral oil is sufficient to drastically reduce its flash point, which generates an industrial hazard when the oil is recycled to the method. It requires the use of a second separation operation herein designated as oil purification. The purification step adds up cost to the method since it is a slow and high cost operation. Another issue related to the cost is the volume of the second solvent involved in the method. The larger the volume of the first solvent entering with the yarn in the extraction unit, the greatest will be the consumption of the second solvent. Which consumption can also be increased by the ineffectiveness of the extractors.

Manipulation of a large volume of the second solvent leads to a greater investment in the solvent recovery unit and higher industrial hazard. One of the criteria for ranking hazard radius is the volume of flammable solvent present in the industrial area. Another issue related to the volume of the first solvent is the amount of the second solvent to be evaporated in the drying unit. Since the amount of the first solvent is substituted with approximately the same amount of the second solvent in the extraction method, the lower the volume of the first solvent entering the extractors, the lower will be the amount of the second solvent to be evaporated in the drying unit.

The present invention further provides a pre-recovery system 4 (or pre-recuperator), comprising five main optional devices. The first device comprises a tower of feeding rolls 40 of the pre-recuperator 4, wherein the number of rolls depends on factors such as the stretching strength and the minimum contact perimeter for no slippage to occur. In practice, the number of rolls, as well as the diameter thereof is the result of a relationship between the cost of the machine and the likelihood of slippage. The number of rolls outlined in FIG. 1 is therefore merely illustrative.

The tower of feed rolls 40 can also serve as a tower of spinning rolls, that is, to pull yarns formed on the spinning die passing through the quenching bath. Since the yarns passing through the quenching bath carry an amount of water and first solvent, a collector tray can be mounted on the lower part of the tower, which will receive any amount of these solvents from the rolls.

The pre-recovery system illustrated in FIG. 1 optionally comprises a drawing tank 410, where a liquid serves to provide heat to the gel yarn, which will be stretched between the feed tower 40 and a first pre-recovery enclosure 42. The drawing bath basically comprises a drawing tank, a lid, at least one driver (two drivers are illustrated) for immersion of the yarn into the tank, a drain, a heat exchanger and a circulation pump.

Using immersion drivers facilitates passing the yarns through the tank during the start operation, such that the drivers are capable of drawing the yarn inside the tank, pushing the yarn to the bottom of the tank. The immersion drivers serve, therefore, to maintain the yarn immersed in the tank after being passed in the start operation.

The tank can also comprise a lid serving to isolate the system from external contamination, to prevent accidents by the contact of the heated liquid and to thermally isolate the tank.

Circulation of the heated liquid within the tank may be optionally performed with the aid of a pump and a heat exchanger, together with an inert gas disperser. Dissolution of the inert gas into the liquid is recommended when the drawing liquid medium is the mineral oil used as first solvent. In a stable stage of the method, an inert gas-containing atmosphere injected into the disperser is formed between the surface of the liquid and the lid. The design of the tank must take into account a low inventory and the absence of neutral positions for no additional degradation of the first solvent to occur in this step.

The third part of the pre-recuperator comprises a first pre-recovery enclosure 42. The first pre-recovery enclosure 42 serves to retain the major portion of the first solvent exudated during drawing in the tank, as well as the liquid used as a thermal medium in drawing, which is dragged by the yarn. The first pre-recovery enclosure 42 has a roll tower having two main functions, the first is to draw the gel yarn that passes the drawing bath and the second is of acting as a support where mechanical action of compressed air knives and scrapers will retain any liquid contained on the surface of the yarn filaments.

In context of the present invention, compressed air blades are optionally used to prevent a large portion of the liquid volume dragged by the yarn from passing to the next steps together with the yarn. When yarns containing the filaments are driven onto the surfaces of rolls, the filaments spread as ribbons. Surprisingly, when compressed air blades are duly directed tangentially (relative to the roll) and transversally (relative to the gel yarn), a major amount of liquid is retained.

Part of the retained liquid is projected away from the roll surface and a portion of the liquid is adhered thereto. Therefore, to prevent part of the liquid adhered to the roll from wetting the yarn, optionally a scraper device is adapted so as to transfer this volume to the end of the roll. Devices transforming compressed air into laminar flows of high speed are found commercially. An example is the so-called air knives from Spraying Systems Co® capable of concentrating a compressed air jet in very precise geometrical shapes, which considerably reduces air consumption. Optionally, other liquid retention devices can be used, such as rubber-coated devices commonly known in the textile industry, such as Foulards.

The use of devices for liquid retention, especially air blades, has shown to be suitable for retaining the mineral oil, wherein one can observe that air penetrates between the yarn filaments, expelling a large amount of liquid. The use of air knives, or any device operating in an obvious manner, along with another support device capable of removing the liquid adhered to the surface of the draw roll are considered herein as the mechanical driving power that was shown to be sufficiently more efficient than decantation and made it possible for one to recover a large volume of the first solvent prior to the use of a chemical action (use of the second solvent).

As illustrated, the present invention provides air knives and rubber scrapers onto the rolls. The representation is schematic and other assembly configurations are possible. For practical purposes, the above described equipment is mounted inside a housing that encloses it.

Further, a tray is optionally installed on the lower part of the enclosure 42 and serves as a collector of the liquid bulk, while an upper protection serves as a guard to projections of liquid caused by compressed air, such that the upper protection may further comprise a tube serving as an obstacle to liquid particles and to the sound, while letting air pass through.

Drainage of liquid from the bottom of the tray can be made directly to a solvent recovery area or it can be recycled back to the drawing tank with the aid of a pump. The advantage of the latter configuration is that the tank will always have a level that tends to be greater than the level of a drain. If the liquid accumulated on the bottom of the tray of the pre-recovery enclosure is directly conveyed to the solvent recovery area, a liquid feeding device must be installed on the drawing tank, ensuring replacement of the liquid medium lost by dragging by the yarn that is stretched and enters the pre-recovery enclosure.

Optionally, if one desires to completely isolate the interior of the enclosure 42, a Foulard rubber roll device can be used. The use these devices aids in retaining liquid, in addition to isolating the enclosure. However, to ensure that no damages are made to the yarn, a low closure pressure should be used together with low hardness rubbers.

For the purposes of providing hearing comfort, the housing can be optionally insulated with any sound insulation elements.

In the present context, it is important to define the meaning of free liquid volume onto the surface of the filament. The gel yarn is characterized by a porous structure (very similar to a sponge when seen in cross section) containing a large volume of liquid (first solvent). When the gel yarn is formed, part of the volume of oil is expelled to the yarn surface. If a segment of gel yarn is let to rest with fixed ends, part of the oil will run off on the yarn under the action of gravity and part of the oil will remain inside the pores in a "stable" manner, being held capillarity forces. Based on this phenomenon, we will define hereinafter that the free liquid volume is the entire volumetric fraction that can be retained or recovered by a certain mechanical principle.

On the other hand, the stable volumetric fraction is defined as the volumetric fraction that cannot be recovered by such a mechanical action, provided that the mechanical forces involved do not overcome the capillarity forces. Another important aspect Is that liquid exudation caused by a deformation made while drawing the gel yarn is meant to be a consequence of the anisotropy given by the orientation. In other words, the crystallization to which the polymer is subjected while being drawn associated with a change in the aspect ratio of the pores under the action of the same deformation is responsible for transforming the stable liquid volume into a free liquid volume. Thus, a major part of this phenomenon would take place in the drawing bath.

However, experimental data show that oil exudation by the pores of the gel yarn is a slow method as compared to the average residence time in the bath and in the first pre-recovery enclosure. In other words, after deformation is determined, a certain period of time is required for a corresponding portion of the stable volume to exudate, transforming into the free portion, such that it can be retained by compressed air blades. In a continuous regimen, this is a problem because while a higher draw ratio in the bath allows for a greater displacement of the stable portion to the free portion, the same increase imposes a higher speed of the yarn along the internal path of the first pre-recovery enclosure 42, reducing proportionately the residence time for the air blades to be able to work. Such a loss in efficiency with the increase in the draw ratio would lead to a proportional increase in the residence time, which would increase the cost in equipment.

However, experiments have also shown that withdrawal of the free oil by the air blades is a fast method as compared with the exudation time. In other words, to simply increase the path of the yarn in the first pre-recovery enclosure would not be the most efficient manner to improve retention efficiency, since the cost of the equipment and the consumption of compressed air would increase considerably.

Therefore, in order to increase efficiency of the pre-recovery unit with the least impact possible on the cost of the equipment, the idea of optionally adopting an accumulator 43 was conceived. In context of the present invention, accumulator 43 is any configuration of textile equipment capable of increasing the path of the yarn in the most compact manner possible, for the time required for the exudation method to occur.

In the optional configuration disclosed, the accumulator 43 comprises two columns of idlers or rolls that can conduct the yarn so as to prevent the occurrence of damages or titer oscillations. Adjustment in the residence time is carried out by the number of "zig-zag" turns and by the distance. Rolls or idlers can be free or motor-driven. Conceptually, the use of a powered transport system would not be required, since the two pre-recovery enclosures 42,44 would serve to guide the yarn. However, to prevent that friction variations on the roll or idler axes can cause titer instabilities in the gel yarn, a powered configuration can be optionally adopted. In addition, such a powered drawing device can be designed such that an elevation gradient can be provided along the yarn path. This would allow for a small stretch to be made in the accumulator 43, thereby preventing any degree of relaxation of the gel yarn along the path.

The fifth and last part of the pre-recuperator unit is the second pre-recovery enclosure 44. The description of the second pre-recovery enclosure 44 is the same as the first, as described above, such that the second enclosure serves to retain the first solvent exudated along the path of the accumulator.

Conceptually, any liquid may be utilized as a drawing medium in the drawing tank. However, in the scope of the present invention, the liquid itself used as the first solvent or water are preferably adopted. However, any other liquid other than those mentioned above may adversely affect the method, since other separation operations must be used, then burdening the solvent recovery area.

When the liquid itself used as first solvent is used as a thermal transfer medium in the drawing tank, a small pre-recovery enclosure (not shown) can be adapted on the feed tower to retain the water dragged from the quenching bath. Experience acquired from experiments using air blades has shown that the water dragged by the wire exiting the quenching bath is relatively easy to retain. Water forms small drops on the gel yarn surface, being very exposed to the action of air streams.

In practice, the choice of the liquid used in the tank will depend on the drawing temperature. When the desired work temperature range is between room temperature and 80° C., water is the preferred liquid in the scope of the present invention. The gel yarn has a high amorphous fraction, which enables high draw ratios to be obtained at a temperature of less than 80° C. On the other hand, the draw ratio is limited by the low motion of the chains in the crystalline phase. The use of temperatures of greater than 80° C., achieved by using mineral oil as a thermal medium, makes it possible to obtain high draw ratios with no damage to the microstructure of the gel yarn and, as a result, obtaining high pre-recovery index values. In this context, the draw ratio applied to the gel yarn must be greater than 1.5:1, preferably greater than 5:1 and more preferably, greater than 8:1.

While the use of high draw ratios in the gel yarn is beneficial for high fractions of free oil to be obtained, efficiency of pre-recuperators is very reduced by decreasing the residence time (increased speeds). To compensate for that, all the features of the pre-recovery enclosure 42,44 must be optimized. The number of sets of air blades must be increased at the same proportion as the draw ratio applied to the gel yarn. In context of the present invention, the number of sets of air blades must be higher than 1, preferably higher than 4, more preferably higher than 6. Preferably, the number of sets of air blades per roll must be 1. However, a greater number can be used. The distance between the air blade and the surface of the roll must be adjusted as a function of the compressed air pressure used. Very high pressures associated with small distances are limited by the entanglement of the yarns and even by the displacement of the path thereof on the roll perimeter. In context of the present invention, the distance between the air blade-generating device and the surface of the roll must be lower than 60 mm, preferably lower than 40 mm, more preferably lower than 20 mm. Pressure used in the air blade-generating device depends on the device used. However, the used pressure must be limited by the entanglement of the yarn or by another instability that can cause any damages to the yarn or any processability problems in the spinline. There are many ways to position the air blade relative to the yarn. In context of the present invention, the preferable positioning is such that flowlines of the air blade are directed away from the motion of the yarn and are tangential to the roll surface.

Using textile features to accumulate yarns 43 between the two pre-recovery enclosures 42,44 is the key factor in the efficiency of the pre-recovery unit 4. If a textile configuration is used, as shown, the distance and the number of zig-zags must be adjusted such that a residence time of greater than 0.5 minute is achieved, preferably a residence time of greater than 1 minute and more preferably greater than 2 minutes will be sufficient for the major part of the stable oil to be transformed into free oil.

In context of the present invention, preferably, rolls or idlers used in the accumulator columns move independently from each other, that is, the use of powered mechanical devices is preferred. When such a configuration is used, the ratio of the speeds of the rolls must be adjusted so as a global draw in the accumulator of greater than 1.05, preferably greater than 1.1 and more preferably greater than 1.2 is applied. For no damages to occur in the yarn microstructure, a global draw ratio in the accumulator must be of less than 5, preferably of less than 3 and more preferably of less than 1.5.

Therefore, the pre-recovery system now described optionally comprises:

a) a tower of feed rolls 40 where the number of rolls is sufficient to prevent slippage of the yarns, wherein, optionally, the tower 40 may contain a liquid retaining device 402 and a first solvent which are occasionally dragged from the quenching bath 30, and wherein, to prevent loss of solvents and water, a collecting tray can be placed below the rolls;

b) a drawing tank comprising 41 a liquid medium serving to transfer heat to the yarn and to collect the volumetric fraction of the first solvent exudated during the residence time in the tank, wherein said tank contains an system of immersion rolls to facilitate passage of the yarns, wherein the tank can also comprise a liquid circulation pump contained in the tank, a heat exchanger, a drain and a lid, such that, when the liquid used is the first solvent itself, an inert gas feeding device may be used to prevent degradation of the liquid.

c) a first pre-recovery enclosure 42 optionally comprising:

- a second roll tower or a yarn accumulator serving to draw the gel yarn while it passes through the drawing tank, such that drawing is given by the difference in the speeds between towers 40,42;
- air flow generating devices, such as air blade devices, where compressed air is used to retain the volumetric fraction of the first solvent that is available in the free form, on the filament surfaces of the yarns, while they are transported by the rolls of the second tower 42, such that these devices are preferably directed away from the motion of the yarns and such that the air blade is tangential to the roll surface;
- scraper devices duly coupled to the tower rolls, serving to retain liquid adhered to the surface of the rolls, preventing them from wetting the yarns;
- an external environment-insulating case or housing, comprising walls with some sound-absorbing features, a liquid collecting tray positioned below the rolls and an air exhaustion tube installed on the top of the enclosure 42, which can contain elements that retain liquid and sound particles;

d) a yarn accumulator 43 optionally comprising two roll towers where the yarns can travel a "zig-zag" path in order to maintain the yarn for a period of time sufficient for the first solvent to exudate, being available at the surfaces of the yarn filaments;

e) a second pre-recovery enclosure 44, preferably comprising features similar to those of the first pre-recovery enclosure, however, due to a possible increase in the speeds in the previous steps, the second enclosure may comprise a higher number of air blade generating devices.

Furthermore, according to the optional configuration described herein, the pre-recuperator now proposed optionally comprises:

a) a pre-recovery index expressing the fraction of the first solvent retained by the pre-recuperator 44 and which will not contact the second solvent in the extraction step, wherein the pre-recovery index is greater than 20%, preferably greater than 50% and more preferably greater than 70%;

b) drawing in a liquid medium, which takes place between the first two roll towers of the pre-recuperator, while the yarn is submersed in the tank, characterized by a draw ratio applied to the gel yarn that is greater than 1.5:1, preferably greater than 5:1 and more preferably greater than 8:1;

c) drawing in liquid medium, which takes place between the first two roll towers of the pre-recuperator, while the yarn is submersed in the tank, wherein: a temperature between room temperature and 80° C. is adopted when water is used as a drawing medium in a liquid bath; and a temperature greater than 80° C. is adopted when the first solvent itself is used as a drawing medium in a liquid bath, while a draw ratio greater than 8:1 is applied to the gel yarn;

d) a residence time in the yarn accumulator of greater than 0.5 minute, preferably, a residence time of greater than 1 minute and more preferably greater than 2 minutes, which will allow for a fraction of stable volume to be transformed into free volume, and can also be retained in the second pre-recovery enclosure.

It is then clear that retention of the higher amount possible of the first solvent, ensured by the optional configuration of the proposed pre-recuperator, represents a great technical and economic advantage over the state of the art. However, recovering in an efficient manner the larger volume possible of the first solvent prior to feeding the extractors is not the only advantage described by the present invention.

To render the mineral oil based technology even more competitive than the decalin based technology, when all the aforementioned aspects are taken into account, it is also interesting to develop concepts related to a greater efficiency of the extractors 50. Therefore, the present invention also provides for the use of extractors, as those disclosed and described in document PCT/BR2014/050004 dated Oct. 29, 2014.

Thus, in accordance with the optional configuration of the present invention described so far, and based on the extractors defined in the cited document or any other extractor known from the state of the art, when the yarn exits the extractors 50, almost all the volume of the first solvent was substituted with the second solvent. Subsequently, the gel yarn containing the less volatile solvent (second solvent) is then subjected to an optional drying process at a low temperature in order not to damage the microstructure thereof.

FIG. 1 further illustrates an optional configuration of a drying device 6, or dryer, which can be used according to an optional configuration of the present invention. Any yarn, ribbon and/or fabric drying devices known in the state of the art can be used for the purposes of the present invention. However, in order to avoid variation in the titer or linear density of the yarn during drying, biased zig-zag conveyors in all the conveyor rollers and a precise stress control, wherein the conveyor rollers 61 can also be heated. Further, any homogenous heat source can be used, but heated inert gas forced circulation is optionally adopted.

Optionally, the drying device further comprises at least one dry gas inlet aperture and at least one wet gas outlet aperture, such that a gas is circulated in a closed-loop between the dryer 6 and the recovery units 5 of the second solvent.

When the yarn exits the drying unit, with practically no residue of the second solvent, it is designated xerogel yarn. Xerogel is a term used in sol-gel chemistry to describe a gelled structure that lost the liquid phase (dry gel).

The xerogel yarn is then continuously fed to at least one cold drawing roll tower 7, optionally two, as illustrated in FIG. 1. For the same reason as discussed for gel yarn drawing, it is economically interesting that the drawing portion can be cold, especially due to the orientation of the amorphous phase, provided that the limit of damage to the crystalline structure (that has no cold motility) is respected. However, this step is optional.

The pre-drawn xerogel yarn is then subjected to a hot draw process in a hot drawing device 8. It should be noted that hot drawing can be made in a single stage or multiple stages. Thus, the schematic illustration of components set out in FIG. 1 is intended to provide understanding on the method. Other types of ovens, rolls and drawing godets and types of ovens present in the state of the art can be used in the hot drawing of the method described in the present invention.

The progressive increase in speeds applied to the yarn in a continuous manner results in high stresses to which the yarn is subjected, as a consequence of the high draw rates applied. The draw limit can then be overtaken by breaks in the yarn, which mainly occur in the final steps after the formation of the so-called precursor yarn. A yarn has a distribution of defects, where at each defect, a critical tensile strength is associated therewith. For an acceptable operability of the production, the drawing stress should be the lowest possible. There are many ways to reduce the drawing stress, wherein the most important ones are the increase in lengths of the drawing lines and the temperature, since a reduction in the speed is not possible under a continuous regimen.

The temperature, in turn, is limited by the softening point of the yarn, which is caused by an approximation of the temperature of transition from the orthorhombic crystal to the hexagonal crystal, which evolves with the microstructure evolution. On the other hand, the length of drawing lines is limited due to economic reasons. It explains the production of the HMPE yarn in a second step designated herein as post drawing. One way to reduce the global stress of the yarn in the stage of production of the POY yarn is to use multiple drawing steps wherein, between each two steps, a stress relaxation is applied to the yarn. Due to its high molecular weight, the HMWPE has high molecular relaxation times. The use of ovens for stress relaxation allows for molecular segments to slide and to be oriented before a new drawing step is applied. The result of this is the possibility of applying high draw ratios in a continuous regimen.

In a preferred context of the present invention, upon drawing the precursor yarn, which is performed in a minimum of two steps, wherein between the two steps a step of stress relaxation is applied, when a step of stress relaxation is applied the time of stress relaxation should be greater than 5 seconds, preferably greater than 10 seconds. In this regard, the relaxation temperature should be intermediate between the drawing temperatures prior to and after relaxation. Also, the speed of the yarn over the relaxation step must be preferably equal to or of at most 2% greater than the last speed of the drawing step.

In all the drawing cases described after the yarn passes through the extractors, the present invention optionally provides the application of specific drawing criteria, which cause the yarn to meet the ideal manufacturing conditions. To that end, the draw ratio in a continuous regimen should be defined by equation $$\lambda_C = \frac{\lambda_{max}}{\lambda_{PD}}.$$

Such that the maximum draw ratio ($\lambda_{max}$), also defined as the global draw ratio applied to the precursor yarn, and the draw ratio specifically applied to the POY yarn the in post-drawing step ($\lambda_{PD}$), should follow the following restrictions.

The maximum draw ratio ($\lambda_{max}$) is the maximum or global draw ratio defined based on the survival index of the population of POY yarns being drawn, where the population of yarns (n) fed to the drawing unit and which survive without breaking throughout the step of production is defined by:

$$\text{Survival_Index}\,(\%) = \frac{(n-f)}{n} \times 100 > 70\%$$

Wherein n is the population of yarns fed in the drawing of the post drawing step, and f is the number of breaks during the post drawing step.

Furthermore, the draw ratio specifically applied in the post drawing step ($\lambda_{PD}$) should satisfy the following equation:

$$1.5<\lambda_{PD}<3$$

When drawn under minimum slippage conditions between chains, the elastic modulus of the flexible polymers increases with the draw ratio. Thus, the modulus of a partially oriented fiber consists of a combination in series of the elastic modulus of perfectly oriented (crystalline) phases, $E_c$, with the elastic modulus of disoriented (amorphous) phases, $E_u$, as defined by the equation:

$$E=(\varphi E_C^{-1}+(1-\varphi)E_u^{-1})^{-1}$$

The drawing process causes the fraction of oriented material φ, which is only a function of the draw ratio λ, to increase as the fraction of disoriented material (1−φ) decreases. This model was successfully applied to describe the evolution of the drawing modulus in different HMPE fibers. As will be better detailed hereinafter, the value of $E_c$ found in φ these analyses by adjusting the data least squares to the above equation model is typically of the order of 250 to 350 GPa, and is in agreement with the modulus of the crystalline regions of the microstructure. The values of $E_u$ found in these analyses are of the order of 1 to 2 GPa and are closer to the modulus of the glass PE (2.9 GPa) than the amorphous PE (5 Mpa).

According to the literature, this fact can be explained by the restriction imposed on the amorphous chains by the crystalline regions surrounding it. That is, the elastic modulus $E_u$ of the disoriented phase is a direct consequence of the microstructural organization of the microfibrils. From the mechanical point of view, the ideal microstructure must be the more homogenous and crystalline as possible. It means that in the drawing process it is possible to eliminate as much as possible the shorter period lamellae of high electronic contrast.

Thus, considering this microstructural model, the final elastic modulus of the fiber with a certain microstructure is only dependent on the draw ratio. This is in turn limited by the molecular weight of the polymer and by the concentration thereof in the initial spinning solution, as explained above. In contrast, for the same draw ratio, as the modulus of the disoriented phase $E_u$ increases by a microstructural organization specifically designed to that end, one can greatly increase the final elastic modulus of the fiber.

Finally, the yarn is wound on a winding unit 90. Between the end of the hot drawing and the beginning of winding, the yarn may receive any finishing used in the state of the art to provide the yarn with some improvement in its properties and processability in the final application. Any winding device disclosed in the state of the art can also be used to wind the yarn. Since the method is continuous, there is no limit to the weight of the bobbin in question.

For the purposes of reducing costs related to a drawing machine or to gain mechanical properties, the yarn obtained by the method described in the present invention can be drawn somewhere else where a drawing machine having suitable dimensions and length can be used. Where this type of configuration is used, the method of the present invention will be characterized as semi-continuous.

Surprisingly, the yarn made according to the present invention has shown a microstructure that is not present in the state of the art, wherein a yarn having high microstructural order meets unexpected performance and industrial viability criteria.

More specifically, the yarn made according to the aforementioned process steps has shown characteristics of evolution of the elastic modulus (E) with respect to the "molecular draw ratio" (MDR) throughout the drawing steps of the precursor yarn, such that the modulus $E_u$>2 GPa is achieved. Preferably, $E_u$>5 GPa. The $E_u$ value is determined by adjusting the least squares of experimental data of the fiber modulus as a function of the molecular draw ratio (λ) with equation $E=(\varphi E_C^{-1}+(1-\varphi)E_u^{-1})^{-1}$, using for φ the function:

$$\varphi(\lambda) = \frac{3\lambda^3}{2(\lambda^3-1)}\left(1-(\lambda^3-1)^{-1/2}\,\text{ArcTan}\left[(\lambda^3-1)^{1/2}\right]\right)-\frac{1}{2}$$

Further, the yarn of the present invention has a microstructure that cannot be found in the state of the art, which was disclosed herein by means of SAXS experiments, characterized by the following microstructural parameters:

- an average aspect ratio of nanopores ($AR_v$) of greater than 50, preferably greater than 80, more preferably greater than 100;
- an angular dispersion of the nanopores ($\beta_v$) of less than 40 mrad, preferably of less than 35 mrad, more preferably of less than 30 mrad;
- drawability of the crystalline phase (Λ) greater than 0.2, preferably greater than 0.3, more preferably greater than 0.4;
- an average aspect ratio of the crystallites ($AR_C$) of greater than 1, preferably greater than 2, more preferably greater than 4;

a short period lamellar microstructure fraction ($f_L$) of less than 0.1, preferably less than 0.05, more preferably less than 0.01.

The first two parameters measure the shape and organization of nanopores. $AR_v$ measures the aspect ratio (ratio of the length to diameter) of the nanopores, both determined by the profile of the perpendicular streak observed in SAXS, wherein $AR_v=T_v/D_v$. Such that, the greater this parameter, the better will be the mechanical properties observed in the yarn of the present invention. At the same time, the more oriented, the better the mechanical properties. This parameter is also determined by the profile of the perpendicular streak observed in SAXS.

The following three parameters refer to lamellae of the microstructure. The third parameter measures the ratio of the draw ratio of crystallites to the draw ratio of the fiber $$\left(\Lambda = \frac{L_{p1}/L_{p0}}{\lambda_1/\lambda_0}\right),$$

that is, it measures the amount of stretch to which lamellae are effectively subjected in the drawing process of the yarn fiber. Ideally, all the draw must be effectively transferred to an increase of the crystallites. Such drawability is measured from a linear adjustment of long period data of the fibers in each draw ratio from the first step, as exemplified in equation $$\Lambda = \frac{L_{p1}/L_{p0}}{\lambda_1/\lambda_0}.$$

The final aspect ratio of the crystallites is measured by the ratio of the length of the crystallites to the diameter thereof ($AR_C=T_C/D_C$, both determined by the SAXS adjustment of the peaks of paracrystalline lamellae.

Figure 2:
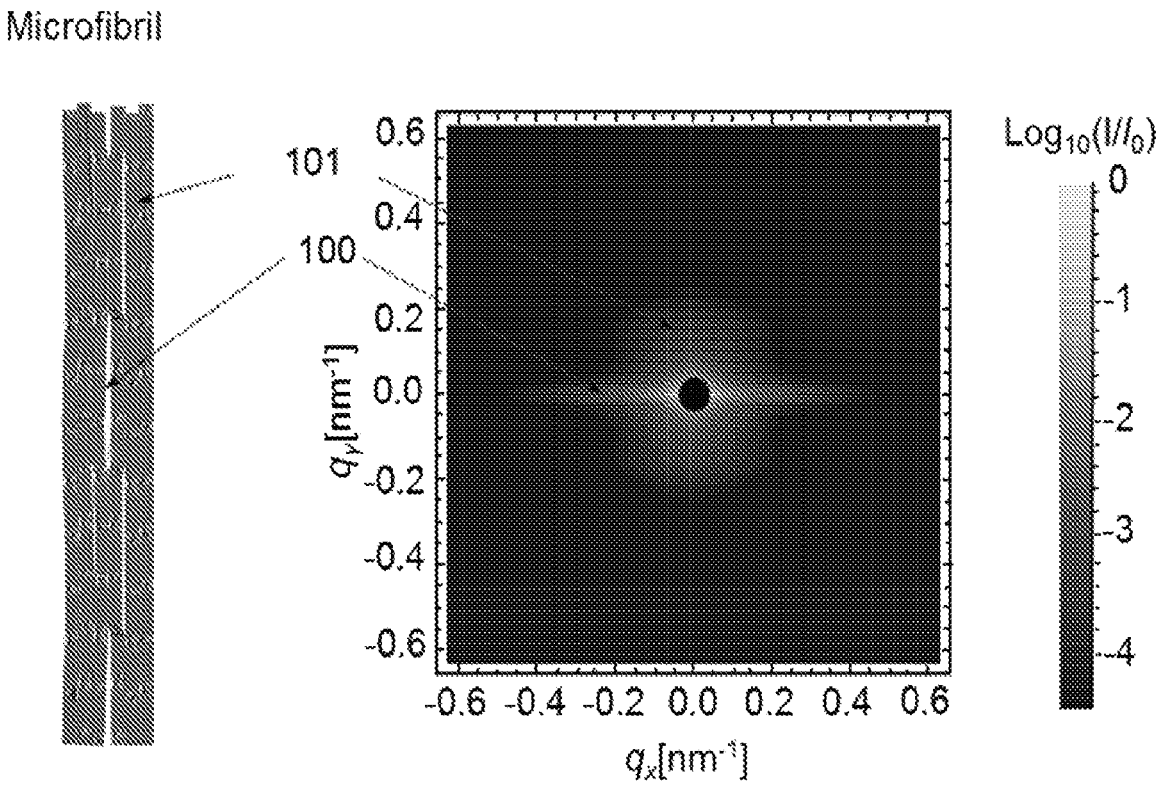
FIG. 2 illustrates a theoretical SAXS diffractogram of a HMPE fiber with microstructure formed by alternating amorphous and crystalline regions and with the presence of nanovoids.

FIG. 2 discloses the theoretical diffractogram of a HMPE microfibril together with the structural origins corresponding to the most remarkable aspects of the diffractogram. The grayscale intensity scale of the diffractogram is logarithmic and spans about 6 decades. This is essential to distinguish the spreading of nanopores 101 (more intense streaks perpendicular to the fiber axis) from the lamellar spreading (diffuse peaks along the fiber axis). This great difference in intensity between the spreading of nanopores 101 and lamellae is caused by two factors. First, the SAXS intensity is proportional to the square of the volume of the spreading objects. Although the diameter of nanopores 101 and lamellae is of the same order of magnitude, from about 10 nm, the length of nanopores 101 in the direction of the microfibrils is of thousands of nm, while the length of each lamellar period (designated long period) is of the order of 30 to 40 nm. That is, only due to the longer length, spreading of nanopores 101 is of the order of 1,000 times more intense. Secondly, the SAXS intensity is also proportional to the square of the difference in electronic density between nanospreader objects (pores 101, crystallites 100, particles, etc.) and the medium where they are inserted (matrix).

For example, the difference in the average electronic density between the PE and the nanopore (void) is of the order of 330 electrons/nm$^3$. In the meanwhile, the difference between the electronic density of crystalline PE (more dense) and amorphous PE (less dense) is of the order of only 50 electrons/nm$^3$. That is, the intensity of nanopores spreading is also about 40 times as great due to the large difference in electronic density over PE.

Still, the SAXS intensity of the nanopores is about 45,000 times as great as the intensity of each lamellar period. Obviously, this factor can be quite reduced when the volumetric fraction of the nanopores is small (which in the case of HMPE fibers is of the order of 1%). Yet, for both features (nanopores and lamellae) to be observed in the same diffractogram it is necessary that the SAXS camera has a dynamic aperture, i.e., with a ratio of the maximum (detector saturation) to the minimum (noise level) signal measured of at least 6 decades. This is only possible with high brightness sources, detectors of high capacity counting and very low noise cameras available at synchrotrons.

Figure 3:
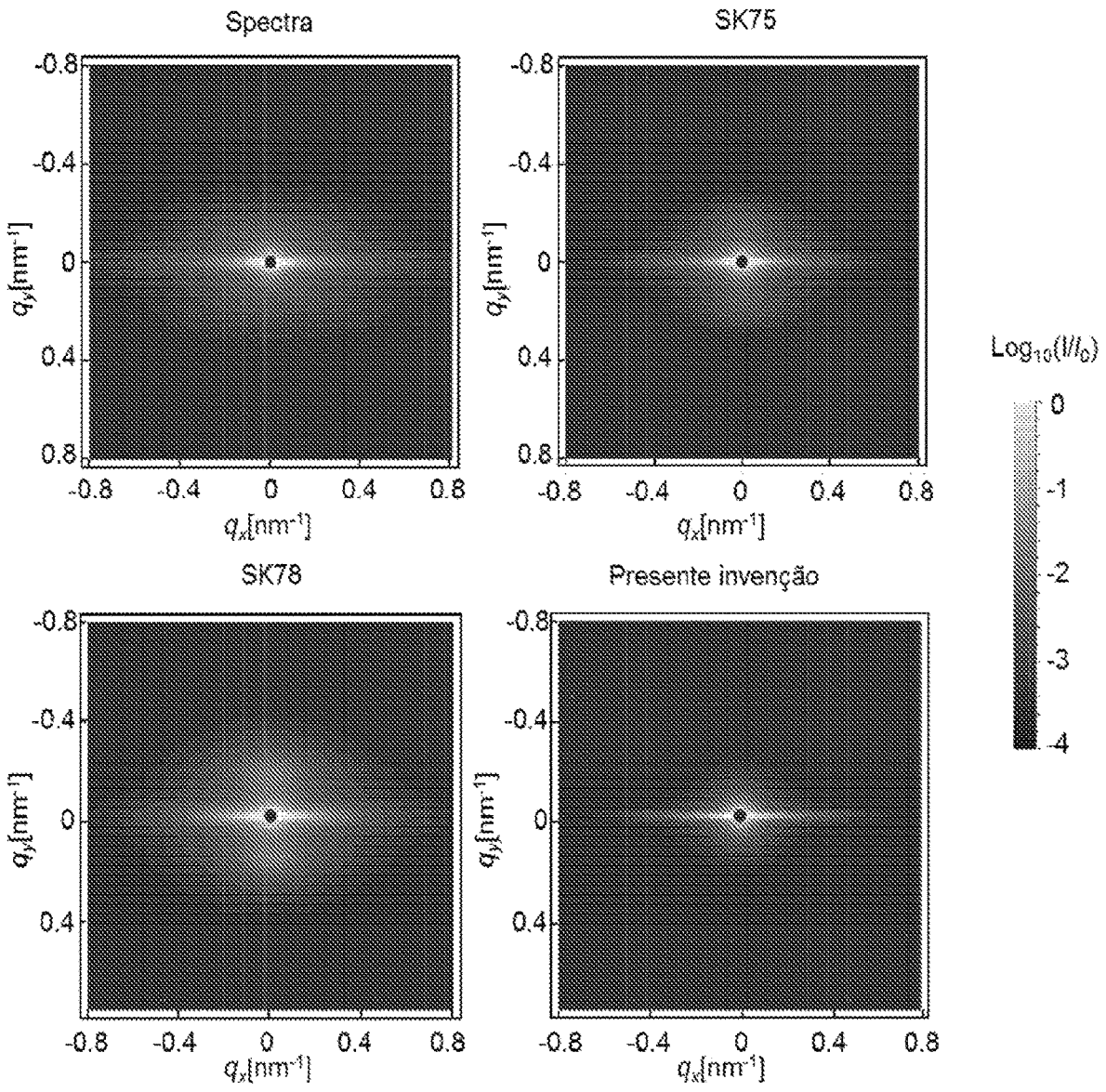
FIG. 3 illustrates SAXS diffractograms of three examples of fibers from the state of the art and one fiber of a yarn of the present invention.

Examples of SAXS diffractograms are set forth in FIG. 3 with intensities normalized to the maximum and presented in a logarithm scale of 5 decades of grayscale. It can be noted that in the diffractograms of Spectra fibers, SK75 and SK78 (both manufactured by a technology known in the state of the art) there is a spreading intensity corresponding to periodic lamellae, according to the template depicted in FIG. 2. In the case of Spectra this intensity is distributed in more diffuse peaks, corresponding to a more disordered paracrystallinity. In SK75 and SK78 fibers, the signature of the lamellae is more clear, being quite evident in SK78. Lamellae formed in the spinning process were maintained even with hot drawing. In contrast, in the fiber of the yarn manufactured in accordance with the present invention, the spreading intensity is more located on the nanopores since lamellae have sizes and paracrystalline periodic repetition that is superior than other commercial ones.

This fact demonstrates the different microstructure of the fibers of yarns of the present invention, wherein lamellae formed in the spinning process were drawn until their long periods could no longer be observed by two dimensional SAXS. In fact, in the penultimate drawing step of the fibers of the yarn of the present invention, the long period is still visible, being superimposed by the spreading of nanopores only in the last step. This coherency is only possible because of a narrower distribution of the starting polymer. This coherency is also evidenced by the evolution of the modulus with the draw ratio.

Figure 4:
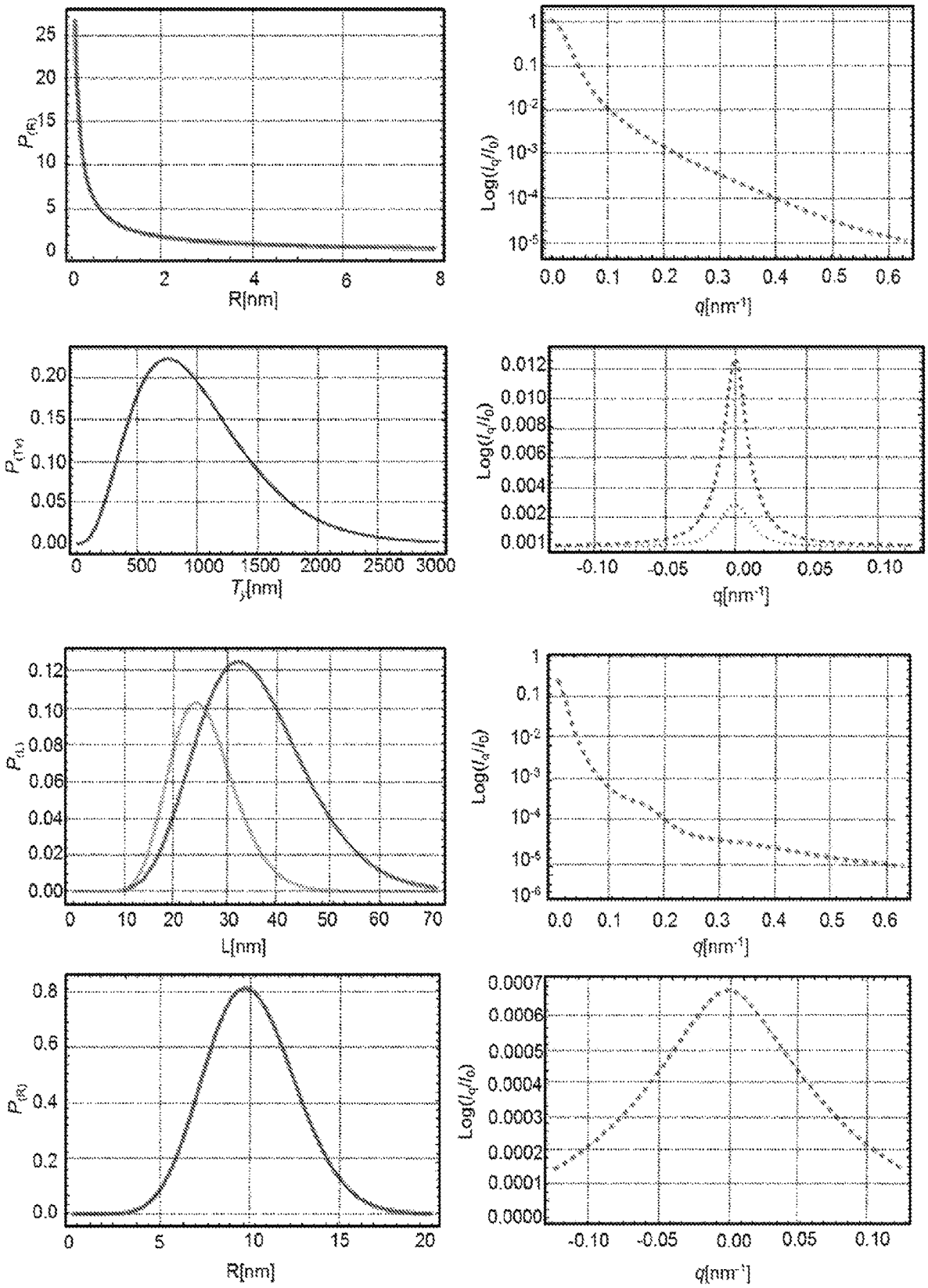
FIG. 4 illustrates microstructural characteristics that can be obtained by an analysis of the scattering profiles in different directions of the diffractogram, wherein the first column illustrates the size distribution, the second column illustrates the intensity profile, the third column illustrates cuts in the diffractogram, and the forth column illustrates the corresponding microstructure.
Figure 4:
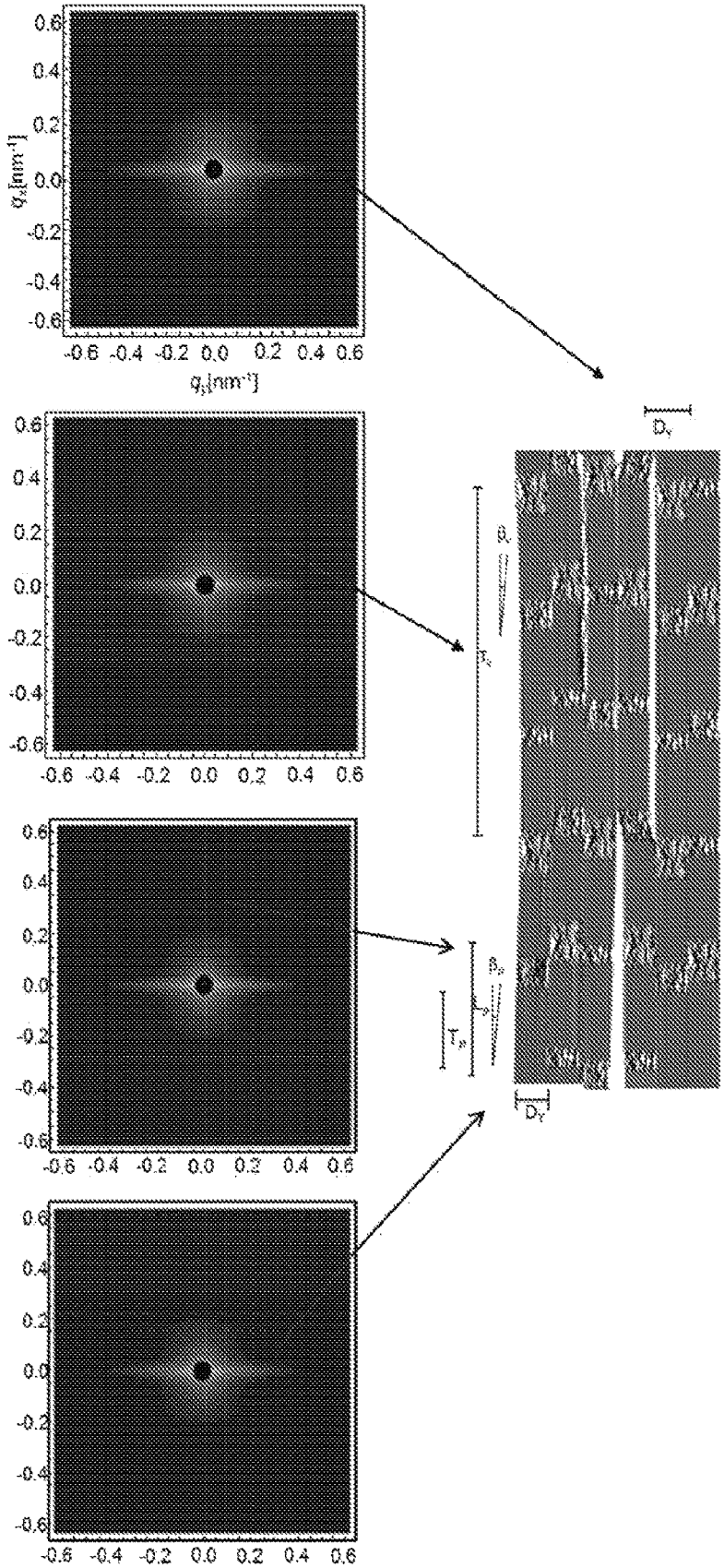

To quantitatively characterize the microstructure, a quantitative analysis of the diffractograms is required. This is made by analyzing the spreading decay profiles, as in FIG. 4. This analysis, which is based on well-established methods, provides distributions of diameter, length and orientation of nanopores and lamellae as a result. These amounts fully characterize the fiber microstructure and can be used as a "finger print". In the present invention, this finger print is an important part of the demonstration that the microstructure created under the conditions disclosed herein is an important step towards the innovation of HMPE fibers.

As can be further noted from the following examples, the yarn prepared based on the restriction conditions now described was shown to have a feature of rapid evolution of mechanical properties with drawing. This feature associated with the drawing conditions used would enable a highly oriented POY yarn to be obtained. When in a continuous manufacture process a relevant number of steps are present, the higher the overall draw ratio necessary for achieving the final mechanical properties, the lower will be the required speeds and accordingly, the lower will be the applied draw rates. As discussed above, low draw rates are required for the consequent stress levels of the yarn being drawn to reduce the likelihood of breakage in the post drawing step.

In the post drawing step the yarn has lower molecular motility than all the other previous steps. Therefore, in this step there is the greatest likelihood of breakage. The features of the obtained yarn along with the applied drawing conditions enabled the preparation of a POY yarn with a small portion of residual drawing to be drawn in the final post drawing step. Therefore, when draw ratios applied in a continuous regimen are sufficient for the remaining drawing of the POY yarn to be lower than 3, then low breakage events are reported.

Thus, the present invention describes a process where under restricted spinning conditions correlated with the choice of the starting polymer, a so-called precursor yarn with a surprising microstructure is obtained and said yarn was shown to have a feature of rapid evolution of the mechanical property with drawing. This property is a result of the formation of a non-oriented phase with unprecedented mechanical properties, having an elastic modulus of about 10 times as great as the values obtained by methods known from the state of the art. This precursor, even after a single drawing step, has a starting lamellar order with long crystallites 100. In the end of the drawing of this precursor, nanopores achieve very high aspect ratios and high orientation and the SAXS signal of the lamellar paracrystalline order, even having a high aspect ratio, nearly disappears, thereby evidencing that the microstructure of the final material has a fibrillar organization that has not been previously observed, leading to mechanical characteristics of ultra high performance fibers.

Applications and uses of the polymeric yarns of the present invention can include ballistic PCT shielding, cable for offshore application, surgical application, in a sports article, and a fishing article, among others. As is evident for a person in the skilled, the aforementioned uses are preferred, but other possibilities are acceptable.

Next, comparisons of the methods, systems and devices of the present invention and those known from the state of the art will be shown. Comparisons between the yarns produced by these processes will also be disclosed.

EXAMPLES

Example 1

A jacketed, stainless steel vessel, which contains a jet mixing circulation system, wherein a pump mounted to the lower part causes forced circulation of the suspension from the bottom to the top, was loaded with 7 kg of a suspension containing 8% polymer powder (a ultra-high molecular weight polyethylene manufactured by Braskem S. A.) in white mineral oil (Emca Plus 350 Oil, manufactured by Oxiteno). The polymer and the mineral oil were chosen such that the criteria of choice of the start formulation components described by the present invention were complied with in order to reduce degradation, 500 ppm Irganox 168 and 500 ppm Irganox 1010 were added, based on the total weight of the mixture. The vessel was closed by a lid containing a stirring rod with five vanes having an impeller angle of 45°, arranged 90° with respect to each other. The set of vanes stirs the entire suspension column. A rotation of 350 rpm was set, while the jet mixing pump was regulated for the entire starting volume to be renovated in approximately 1 minute. A nitrogen stream was adjusted on the bottom of the vessel such that the oxygen content, as measured by a sensor mounted to the bottom of the vessel, achieves values of less than 0.1 ppm in 40 minutes. After this time, the suspension was dosed to a 25 mm twin screw Haake extruder. Dosing was made by means of a vessel containing a level sensor installed in the feeding zone of the extruder. Level control was regulated such that the level of dosed suspension was roughly 10 mm above the screw. The dosage system is automated such that a low level signal is given to a gasket type valve present on the bottom of the suspension vessel, causing the same to open until a new signal of full level is sent by the extruder feeding vessel. This system ensures that only a sufficient amount of suspension is dosed to the extruder, preventing the existence of liquid columns with low level of agitation. A small column of suspension above the screw will be subjected to the agitation action of the screw itself. The temperature of the feed zone of the extruder was maintained below 60° C. while dissolution was carried out at a temperature of 210° C. The spinning pad containing a spinneret with 15 filaments of 0.5 mm in diameter was maintained at 190° C. The flow rate of the spinning pump was adjusted so as to achieve a mass flow rate of 1.5 g/min for each capillary. The spinning conditions satisfy the equations guiding the drawing criteria on the melt (mixture), as described hereinabove. The filaments bundle passed through a 5 mm air gap and a water (quenching) bath at a temperature of 10° C. The yarn was then pulled by a spinning godet at a speed of 10.76 m/min and then fed to the pre-recovery unit. A small draw of 1.02 was applied in all the intermediate steps of the pre-recovery unit, with the exception of the draw in liquid medium and in the Accumulator, where a draw ratio of 4 was applied to the gel yarn. A continuous extractor containing four extraction units was used to wash the gel yarn. A guide yarn was used to prepare the extractor to receive the gel yarn thus produced. Such guide yarn was passed through the Feed Foulard of Extraction Unit 1 and was then wound onto four Rotary Drums of the four units. In each drum, a total of 14 turns were made. The drums are 600 mm in diameter and have an auxiliary roll of 60 mm. The distance between axes is of 600 mm. After passing the guide yarn, doors were closed, the units were inertized with nitrogen until the oxymeter showed an oxygen content of less than 0.1% (v/v). At this moment, the feed pump started loading the units with clean n-hexane. After loading, the machine was pressurized with nitrogen up to a work pressure of 0.4 bar and this condition was maintained throughout the test. Circulation pumps of units 1, 2, 3 and 4 were added and the Drums started pulling the gel yarn with the aid of the guide yarn. The contact time in each unit was of about 4 minutes at the test speed. Feed rate was maintained at 12 L/h. The gel yarn at the outlet of the extractors was fed to a yarn dryer from Mathis. The drying temperature was adjusted to 80° C. and the draw ratio between extractors and the dryer was adjusted to 1.02. A Barmag winding device was mounted on the outlet of the dryer to collect the precursor yarn. After collecting the precursor yarn, the yarn was fed to the continuous drawing machine where a draw of 2.4 was applied in two consecutive steps. The then called POY yarn was collected to the Post Drawing step. To that end, the same drawing machine of the continuous unit was used. Said drawing machine will be described below.

Post Drawing

The POY yarn obtained under the above conditions was fed to a Retech drawing machine containing three modules, two modules being drawing modules and one being a central modulus between the two drawing modules, containing the stress relaxation oven. The feeding tower is formed of a godet followed by a dual roll tower. The central tower is formed of two sets of dual rollers. Such a tower was adapted inside an oven with controlled temperature. The last tower is formed of a dual set of rollers, followed by a godet. The rolls of the third tower can be cooled with compressed air or chilled water. The draw distance in the first step is 3.115 m and in the second step is 5.860 m. Draw ovens comprise "Hot Plate" draw plates where heating is applied by means of a yarn-plate contact. The first oven comprises two 1.260 m plates while the last oven comprises four 1.260 m plates. Each plate has an individual thermal control, which allows for the adjustment of a temperature gradient from the feed godet to the last plate of the second oven. Draw conditions were set such that the draw criteria proposed by the present invention were met.

The obtained yarn exhibited a tenacity of 37.4 cN/dtex, an elastic modulus of 142 GPa, a creep rate at a temperature of 21° C. and stress of 900 MPa of 0.023%/h and a creep lifespan at a temperature of 70° C. and stress of 600 MPa of 16.4 h.

Example 2

The same conditions as described in Example 1 were used in this experiment. However, the temperature of the spinning pad was adjusted to 240° C. and the mass flow rate per capillary was adjusted to 0.6 g/min. The spinning speed was 4.41 m/min. The conditions used in the production of the precursor yarn and Post Drawing were also the same as in Example 1. Here, also, all the criteria of choice of the start and draw formulation components were used.

The obtained yarn exhibited a tenacity of 37.5 cN/dtex, an elastic modulus of 137 GPa, a creep rate at a temperature of 21° C. and stress of 900 MPa of 0.020%/h and a creep lifespan at a temperature of 70° C. and stress of 600 MPa of 7.4 h.

Example 3

The same conditions as described in Example 1 were used in this experiment. However, the mass flow rate per capillary was adjusted at 0.45 g/min. The spinning speed was 3.17 m/min. Speed of the spinning Godet was adjusted such that a draw of 2.0 was applied between the outlet of the spinneret and the surface of the quenching bath. Length of the air gap was adjusted at 30 mm. The conditions used in the production of the precursor yarn and Post Drawing were also the same as in Example 1. Here, also, all the criteria of choice of the start and draw formulation components were used.

The obtained yarn exhibited a tenacity of 42.3 cN/dtex, an elastic modulus of 168.4 GPa, a creep rate at a temperature of 21° C. and stress of 900 MPa of 0.0127%/h and a creep lifespan at a temperature of 70° C. and stress of 600 MPa of 37.5 h.

Example 4: Spinneret of Larger Diameter and Use of Drawdown

The same conditions as described in Example 1 were used in this experiment. However, a spinneret containing 10 capillaries of 1 mm in diameter were used. The mass flow rate per capillary was adjusted at 1.8 g/min for the same spinning speed as used in Example 3 was achieved. Speed of the spinning Godet was adjusted such that a draw of 4 was applied between the outlet of the spinneret and the surface of the quenching bath. Length of the air gap was adjusted at 30 mm. The conditions used in the production of the precursor yarn and Post Drawing were also the same as in Example 1. Here, also, all the criteria of choice of the start and draw formulation components were used.

The obtained yarn exhibited a tenacity of 41.5 cN/dtex, an elastic modulus of 149 GPa.

Example 5

The same conditions as described in Example 1 were used in this experiment. However, a spinneret containing 8 capillaries of 1.4 mm in diameter were used. The mass flow rate per capillary was adjusted at 3.5 g/min for the same spinning speed as used in Example 3 was achieved. Speed of the spinning Godet was adjusted such that a draw of 6 was applied between the outlet of the spinneret and the surface of the quenching bath. Length of the air gap was adjusted at 30 mm. The conditions used in the production of the precursor yarn and Post Drawing were also the same as in Example 1. Here, also, all the criteria of choice of the start and draw formulation components were used.

The obtained yarn exhibited a tenacity of 40.7 cN/dtex, an elastic modulus of 143 GPa.

Counter Example 1

An experiment made under the same conditions as Example 3 was repeated such that a precursor containing a residual draw of greater than 3 was collected by mounting a Barmag drawing machine at the outlet of the dryer. The obtained yarn was drawn in two steps in a FET drawing machine containing two roll towers with a total of 14 heated rolls and a sequence of two forced convection ovens, which results in a total path of 7.5 m. The drawing machine contains a last roll tower containing 7 cold rolls. The yarn was wound in a Barmag winding machine. The temperature of the first draw was adjusted at 130° C. and the temperature of the second step was adjusted at 150° C. The overall draw ratio applied to the yarn was 14.25. The obtained yarn exhibited a tenacity of 31.2 cN/dtex and an elastic modulus of 95 GPa.

Counter Example 2: Precursor Made of a Polymer Having High PDI—Condition Outside the Criteria of Choice of the Start Formulation Components of the Present Invention The experiment was carried out under the same conditions as example 3. However, the polymer used was GUR 4120, with IV of 17.9 dL/g and PDI of 7.94, obtained by GPC (gel permeation chromatography). During the continuous drawing step, the yarn did not tolerate the draw ratios required for the residual draw in the post drawing step to be of less than 3 (conditions defined by the draw criteria of the present invention).

FIG. 5 illustrates a table where the results obtained by the above examples and counter examples are compared. In this table, it is evident that the yarn produced in accordance with the present invention has superior characteristics as compared with the yarns of the state of the art.

Figure 6:
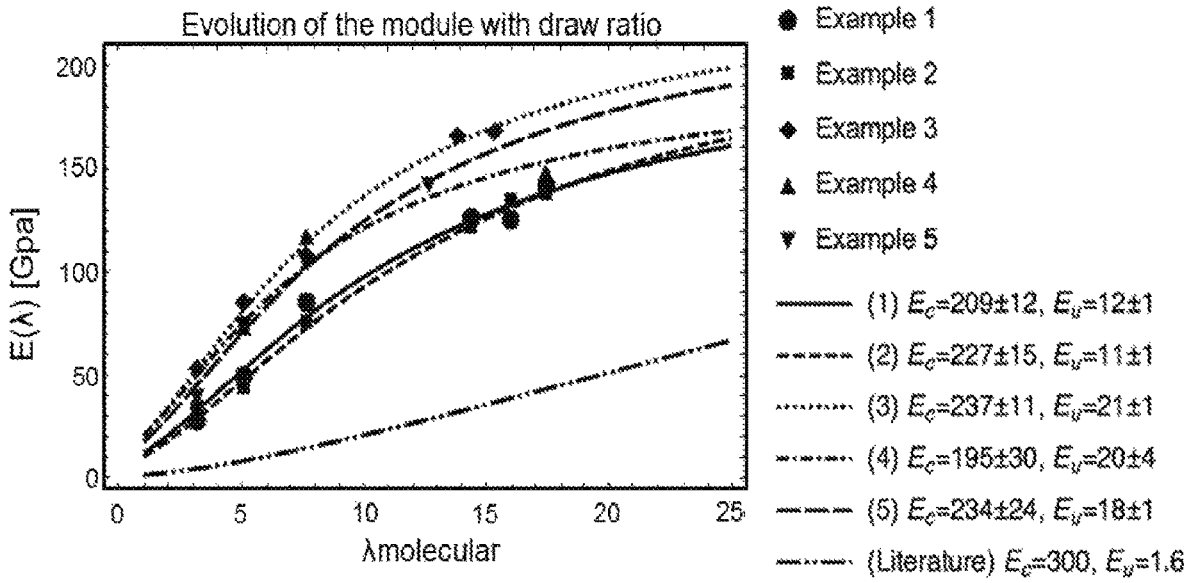
FIG. 6 illustrates a graphic comparison between the examples of yarns produced in accordance with the present invention and yarns produced in accordance with the state of the art.

FIG. 6 illustrates a graphic comparison between the aforementioned examples.

What is claimed is:

1. A continuous method for the production of at least one polymeric yarn comprising the steps of:

mixing a polymer with a first solvent, providing a mixture;

homogenizing the mixture;

rendering the mixture inert;

dosing the mixture in an extruder, forming a homogeneous solution;

dosing the solution in an orifice die, providing the solution with the shape of filament yarn;

immersing the solution with the shape of filament yarn in a quenching bath, wherein an air gap is maintained before the mixture achieves a surface of the liquid of a quenching bath forming at least one gel yarn;

drawing at least once the at least one gel yarn;

washing the gel yarn with a second solvent that is more volatile than the first solvent;

drying the at least one gel yarn; and heat drawing at least once the at least one gel yarn;

the method being characterized in that in the step of dosing the solution in the orifice die:

the minimum speed of the solution at an orifice die inlet is defined by $$V_e > L\frac{T}{\eta_S(T)}\left(\frac{26000}{M_n}\right)^3\phi^{-7/3}PDI^{3/2}e^{\sqrt{\log PDI}}\frac{1}{(\lambda_0-1)};$$

and the maximum speed of the solution at the orifice die inlet is defined by $$V_e < D_e\frac{T}{\eta_S(T)}\left(\frac{26000}{M_w}\right)^3\phi^{-7/3}\sqrt{\frac{\log\lambda_0}{\lambda_0-1}}.$$

2. The method of claim 1, characterized in that the mixture comprises:

a polymer comprising ultra-high molecular weight polyethylene, comprising an intrinsic viscosity of between 5 dL/g and 40 dL/g, and a polydispersity index of between 2 and 10;

a first solvent capable of dissolving the polymer under process conditions, and comprising a dynamic viscosity, as measured at a temperature of 37.8° C., according to ASTM D-445, of greater than 10 cP.

3. The method of claim 1, characterized in that the mixture comprises:

a polymer comprising ultra-high molecular weight polyethylene, comprising an intrinsic viscosity of between 10 dL/g and 20 dL/g, and a polydispersity index of between 3 and 6; and a first solvent capable of dissolving the polymer under process conditions, and comprising a dynamic viscosity, as measured at a temperature of 37.8° C., according to the standard ASTM D-445, of greater than 30 cP.

4. The method according to claim 1, comprising a post drawing step in which the draw ratio is greater than 1.5 and lower than 3.

5. The method according to claim 1, characterized in that the Survival Index is greater than 70%.

6. The method according to claim 1, characterized in that:

the polymer is selected from the group consisting of high molecular weight polyolefin, ultra high molecular weight polyolefin, ultra-high molecular weight polyethylene, high molecular weight polypropylene and ultra high molecular weight polypropylene, ethene-propene copolymer, polyvinyl alcohol, polyesters, polyoxide ethylene, and ultra-high molecular weight polyethylene, and the first solvent is selected from the group consisting of a mineral oil, aliphatic hydrocarbons, cyclo-aliphatic hydrocarbons, aromatic hydrocarbons, and halogenated hydrocarbons.

7. A polymeric yarn, made according to a method for the production of at least one polymeric yarn, said method comprising the steps of:

mixing a polymer with a first solvent, providing a mixture;

homogenizing the mixture;

rendering the mixture inert;

dosing the mixture in an extruder, forming a homogeneous solution;

dosing the solution in an orifice die, providing the solution with the shape of filament yarn;

immersing the solution with the shape of filament yarn in a quenching bath, wherein an air gap is maintained before the mixture achieves a surface of the liquid of a quenching bath forming at least one gel yarn;

drawing at least once the at least one gel yarn;

washing the gel yarn with a second solvent that is more volatile than the first solvent;

drying the at least one gel yarn forming at least one xerogel yarn;

heat drawing at least once the at least one xerogel yarn forming at least one pre-oriented yarn (POY); and heat drawing at least once the at least one pre-oriented yarn (POY) forming at least one yarn;

the method being characterized in that in the step of dosing the solution in the orifice die:

the minimum speed of the solution at an orifice die inlet is defined by $$V_e > L\frac{T}{\eta_S(T)}\left(\frac{26000}{M_n}\right)^3\phi^{-7/3}PDI^{3/2}e^{\sqrt{\log PDI}}\frac{1}{(\lambda_0-1)};$$

and the maximum speed of the solution at the orifice die inlet is defined by $$V_e < D_e\frac{T}{\eta_S(T)}\left(\frac{26000}{M_w}\right)^3\phi^{-7/3}\sqrt{\frac{\log\lambda_0}{\lambda_0-1}}.$$

the polymeric yarn comprising an average aspect ratio of nanopores greater than 50.

8. The polymeric yarn of claim 7, comprising an average aspect ratio of nanopores greater than 80.

9. The polymeric yarn of claim 7, comprising an average aspect ratio of nanopores greater than 100.

10. The polymeric yarn according to claim 7, comprising an angular dispersion of nanopores of less than 40 mrad.

11. The polymeric yarn according to claim 7, comprising an angular dispersion of nanopores of less than 35 mrad.

12. The polymeric yarn according to claim 7, comprising an angular dispersion of nanopores of less than 30 mrad.

13. The polymeric yarn according to claim 7, comprising a drawability of a crystalline phase of greater than 0.2.

14. The polymeric yarn according to claim 7, comprising a drawability of a crystalline phase of greater than 0.3.

15. The polymeric yarn according to claim 7, comprising a drawability of a crystalline phase of greater than 0.4.

16. The polymeric yarn according to claim 7, comprising an average aspect ratio of crystallites greater than 1.

17. The polymeric yarn according to claim 7, comprising an average aspect ratio of crystallites greater than 2.

18. The polymeric yarn according to claim 7, comprising an average aspect ratio of crystallites greater than 4.

19. The polymeric yarn according to claim 7, comprising a short period lamellar microstructure fraction of less than 0.1.

20. The polymeric yarn according to claim 7, comprising a short period lamellar microstructure fraction of less than 0.05.

21. The polymeric yarn according to claim 7, comprising a short period lamellar microstructure fraction of less than 0.01.

22. The polymeric yarn according to claim 7 characterized in that the yarn is used for ballistic shielding, as a cable for offshore application, for surgical application, in a sports article, and in a fishing article.

23. A polymeric yarn, made according to a method for the production of at least one polymeric yarn, said method comprising the steps of:

mixing a polymer with a first solvent, providing a mixture;

homogenizing the mixture;

rendering the mixture inert;

dosing the mixture in an extruder, forming a homogeneous solution;

dosing the solution in an orifice die, providing the solution with the shape of filament yarn;

immersing the solution with the shape of filament yarn in a quenching bath, wherein an air gap is maintained before the mixture achieves a surface of the liquid of a quenching bath forming at least one gel yarn;

drawing at least once the at least one gel yarn;

washing the gel yarn with a second solvent that is more volatile than the first solvent;

drying the at least one gel yarn forming at least one xerogel yarn;

heat drawing at least once the at least one xerogel yarn forming at least one pre oriented yarn (POY); and heat drawing at least once the at least one pre-oriented yarn (POY) forming at least one yarn;

the method being characterized in that in the step of dosing the solution in the orifice die:

the minimum speed of the solution at an orifice die inlet is defined by $$V_e > L\frac{T}{\eta_S(T)}\left(\frac{26000}{M_n}\right)^3 \phi^{-7/3} PDI^{3/2} e^{\sqrt{\log PDI}} \frac{1}{(\lambda_0 - 1)};$$

and the maximum speed of the solution at the orifice die inlet is defined by $$V_e < D_e\frac{T}{\eta_S(T)}\left(\frac{26000}{M_w}\right)^3 \phi^{-7/3} \sqrt{\frac{\log\lambda_0}{\lambda_0 - 1}},$$

the polymeric yarn comprising an elastic modulus of disoriented phases of greater than 2 GPa.

24. The polymeric yarn of claim 23, comprising an elastic modulus of disoriented phases of greater than 5 GPa.

* * * * *